United States Patent [19]

Imai et al.

[11] Patent Number: 5,041,870

[45] Date of Patent: Aug. 20, 1991

[54] ELECTROMAGNETIC RELAY

[75] Inventors: Yoshikiyo Imai, Moriyama; Yoshiharu Kitagawa, Kanzaki; Yuji Yoasuoka, Matsuyama; Yutaka Nozaki, Mukoh; Takashi Tanaka, Takatsuki, all of Japan

[73] Assignee: Omron Tateisi Electronics Co., Kyoto, Japan

[21] Appl. No.: 424,166

[22] Filed: Oct. 20, 1989

[30] Foreign Application Priority Data

| | | | |
|---|---|---|---|
| Oct. 21, 1988 | [JP] | Japan | 63-138014[U] |
| Nov. 1, 1988 | [JP] | Japan | 63-143666[U] |
| Nov. 1, 1988 | [JP] | Japan | 63-143667[U] |
| Nov. 10, 1988 | [JP] | Japan | 63-147718[U] |
| Nov. 11, 1988 | [JP] | Japan | 63-147690[U] |
| Nov. 18, 1988 | [JP] | Japan | 63-151179[U] |
| Nov. 24, 1988 | [JP] | Japan | 63-154050[U] |
| Nov. 25, 1988 | [JP] | Japan | 63-299145 |
| Mar. 28, 1989 | [JP] | Japan | 1-34963[U] |
| Mar. 28, 1989 | [JP] | Japan | 1-34964[U] |
| Apr. 7, 1989 | [JP] | Japan | 1-41435[U] |

[51] Int. Cl.[5] ..... H01H 51/22

[52] U.S. Cl. ..... 335/83; 335/78; 335/202

[58] Field of Search ..... 335/78-85, 335/121, 124, 128, 202

[56] References Cited

U.S. PATENT DOCUMENTS

| | | | |
|---|---|---|---|
| 4,686,500 | 8/1987 | Ide et al. | 335/128 |
| 4,731,597 | 3/1988 | Hinrichs | 335/78 |
| 4,837,538 | 6/1989 | Dittmann | 335/128 |

*Primary Examiner*—Leo P. Picard
*Assistant Examiner*—Lincoln Donovan
*Attorney, Agent, or Firm*—Fish & Richardson

[57] ABSTRACT

An electromagnetic relay with a contact mechanism portion being arranged above an electromagnet portion secured to a base, wherein the electromotive portion is inserted under pressure into the base, is secured, and also, the respective terminals of the contact mechanism portion are inserted under pressure from above into the base and are secured, whereby the electromagnet portion is seucred through the direct pressure insertion thereof into the base, the positional accuracy with respect to the base is increased.

11 Claims, 23 Drawing Sheets

ELECTROMAGNETIC RELAY

BACKGROUND OF THE INVENTION

1. Field of the Invention

The present invention relates to an electromagnetic relay, and in particular, to an assembly structure of an electromagnetic portion to a base and a contact mechanism portion.

2. Description of the Prior Art

Conventionally, as an electromagnetic relay, there is one, wherein an electromagnet portion 103 is accommodated, secured into the central portion of a convex 101*a* of a box-shaped base 101, and contact blocks 102, 102 are accommodated, secured onto both the side portions thereof to have contact mechanism portions 106, 106 provided above the electromagnet portion 103 as shown in, for example, FIG. 39 and FIG. 40.

It is to be noted that 104 is a movable iron piece which drives the movable contact pieces 102*a*, 102*a* through the pivoting operation in accordance with the energization, deenergization of the electromagnet portion 103 so as to open and close the contact, 105 is a hinge spring for pivotally supporting the movable iron piece 104 in a manner of hinge.

However, in the above-described electromagnetic relay, as spare space was not provided within the base 101 in the accommodating, securing operations of the electromagnet portion 103 and the contact blocks 102, 102 within the concave 101*a* of the base 101, the electromagnet portion 103 had to be grasped by the contact blocks 102, 102 through the engagement of the positioning projections 103*a*, 103*a* projected from both the side ends of the electronic magnet portion 103 into the engagement concave portions (not shown) provided in the opposite inner side faces of the contact blocks 102, 102 so as to depress it into the concave 101*a* at one time after it has been positioned above the base 101.

Thus, when even one terminal among the terminals of the contact blocks 102 was shifted in position, the electromagnet portion 103 and the contact blocks 102, 102 could not be accommodated within the base 101, thus taking more time in the assembling operation.

Especially, when an automatic assembling operation was effected by machines, there was a problem that the terminal was bent within the concave 101*a*, defective products were likely to be caused, because the assembling machine was forced to effect the depressing insertion even if the position of the terminal was out of position.

Also, the engagement condition between the positional projections 103*a*, 103*a* of the electromagnet portion 103 and the engagement concave portion of the contact blocks 102, 102 or the contact condition between the contact blocks 102, 102 and the base 101 could not be sometimes flush in the respective upper end faces of the contact blocks 102, 102 due to shifts between each other or could be inclined with respect to the yoke of the electromagnet portion 103. Therefore, there was a problem of producing the defective products in that the positional relation between the contact portions 106, 106 and the movable iron piece 104 of the electromagnet portion 103 was shifted in the design center to prevent the operation characteristics from being provided within the standard, the stage difference was caused in the position of the respective stationary contacts of the contact blocks 102, 102 to prevent the contact pressure from staying within the standard value, and so on.

As the respective terminals of the contact blocks 102, 102 were secured by insert molding (closed molding), there were nothing to do about later adjustments and coordinations even if the shift were caused in the size relation after the assembling operation as described hereinabove, with difficulties in improvements in the yield.

SUMMARY OF THE INVENTION

In view of the above-described problems, the present invention has an object of providing an electromagnetic relay which is higher in assembling accuracy, is easier in the adjustments of the contact mechanism portion, and is lower in price.

In view of the above-described problems, the present invention has an object of providing an electromagnetic apparatus which is easier to manufacture, assemble the parts, and does not operate the electric apparatus defectively.

Also, the present invention has an object of providing an electromagnet which does not have a gap between the stage portion of the iron core and the iron core fixed portion inner face of the yoke or does not have a buckling of the iron core if the length of the iron core and the length of the yoke are different.

Furthermore, the present invention has an object of providing an electromagnetic relay which can detach a hinge spring easily, is better in yield, is higher in productivity without any time taken in the adjusting operation.

In addition, the present invention has an object of providing an electromagnetic relay which is difficult to fail in base, is easier to mold, and is hard to disconnect in coil.

Also, the present invention has an object of providing an electromagnet apparatus, which is smaller in the magnetic resistance at the early stage of the driving, is provided larger in magnetomotive force, and also, is smaller in consumption power.

In order to achieve the above-described objects, in an electromagnetic relay with a contact mechanism portion being arranged above the electromagnet portion secured to the base in accordance with the present invention, the electromotive portion is inserted under pressure into the base, is secured, and also, the respective terminals of the contact mechanism portion are inserted under pressure from above into the base and are secured. In accordance with such construction as described hereinabove, as the electromagnet portion is secured through the direct pressure insertion thereof into the base, the positional accuracy with respect to the base is increased. Also, the relational position with respect to the electromagnet portion may be adjusted by the variation in the pressing engagement into the base of each terminal of the contact mechanism portion.

Also, in an electromagnet apparatus composed of a spool with a through hole provided in the barrel portion, a coil wound around the barrel portion of the spool, an iron core with the outer peripheral face being in pressure contact prevented from being pulled out against the inner peripheral face of the through hole provided in the spool, the spool is made of profile memory synthetic resin, the iron core is inserted into the extended through hole by the deforming operation of the inner peripheral face and is heated, the inner peripheral face restored into the original shape is brought into pressure contact against the outer peripheral face of the iron core to prevent the iron core from being pulled out. According to the electromagnet apparatus of the present invention, the iron core is inserted through a through hole of a spool extended through the deformation of the inner peripheral face, is heated so as to bring the inner peripheral face of the spool restored into the original form into pressure contact against the outer peripheral face of the iron core to prevent the iron core from being pulled out.

Thus, when the iron core is inserted into the through hole of the spool, the condition is a so-called clearance fitting condition, so that large depressing force is not required to insert the iron core into the through hole of the spool and also, the higher size accuracy is not demanded from the spool and the steel core. Furthermore, as the inner peripheral face is deformed, extended wider when the iron core is inserted, the edge portion of the iron core does not cut the inner peripheral face of the through hole, with an effect that the defective operation caused by the shavings is removed.

Furthermore, in the present invention, a coil is wound around the iron core with a stage portion being formed at one end, and also, an electromagnet of a type to crimp, mount an approximately L-shaped yoke on the stage portion side so that the magnetic pole face of the iron core may become flush with the tip end face of the yoke is provided to have the length l1 from the stage portion of the iron core to the magnetic pole face larger than the length l2 to the tip end face from the iron core fixed portion inner face of the yoke, and the yoke may have the hardness relatively lower than the iron core. According to such construction as described hereinabove, when the yoke is secured onto the stage portion side of the iron core so that the magnetic pole face of the iron core may become flush with the tip end face of the yoke, the length l1 of the iron core becomes longer than the length l2 of the yoke, and the yoke 2 has the hardness relatively lower than the iron core 1, so that the stage portion **1*b* of the iron core 1 sinks into the iron core fixed portion inner face 2*b* of the yoke 2, and the mounting operation may be effected without causing the gap between the stage portion 1*b* of the iron core 1 and the iron core fixed portion inner face of the yoke 2 or without causing a buckling by the iron core 1**.

Also, in the electromagnetic relay of the above-described conventional embodiment so as to achieve the above-described object, according to the electromagnetic relay of the present invention, a guide projection for guiding an elastic arm portion of the hinge spring is projected from the portion to be located near the opening portion among the outer side faces of the side walls opposite to the box-shaped base, and also, an inclination face is provided in at least either one contact portion from between the elastic arm portion of the hinge spring and the engagement projection to come into contact when the hinge spring has been depressed along the guide projection. According to the present invention, the engagement hole provided in the elastic arm portion of the hinge spring is engaged with the engagement projection of the box-shaped base simply by the depression of the hinge spring along the guide projection projected from the box-shaped base.

Furthermore, in order to achieve the object, the present invention comprises a box-shaped base, wherein an opening portion is provided sideways, a pair of arm portions provided with a drop groove are projected sideways from the upper portion of the edge portion end face forming the opening portion, an electromagnet portion, wherein a coil is wound around a spool having a flange portion on both the end portions, an iron core is inserted through the central hole of the spool, a projecting one end portion is turned into a magnetic pole portion, while the projecting other end portion is secured to the vertical portion of a yoke having an approximately L-shape in section, and also, a pair of engagement pawl portions are projected from the lower portion on the outer side face of one flange portion, the one pair of engagement pawl portion is exposed sideways through the pressure insertion, the fixing in the axial direction of the iron core from the opening portion of the box-shaped base, a movable iron piece, wherein the shape is approximately L in section, the inner side face angle portion is pivotally positioned in the horizontal tip end portion of the yoke to be exposed from the opening portion of the box-shaped base, a hinge spring composed of a leaf spring, wherein the engagement arm portion projected sideways from both the side upper portions is dropped from above into the drop groove of the box-shaped base to effect the engagement, and also, the engagement leg portion to be projected sideways from both the side lower portions is engaged with the engagement pawl portion of the spool to bring the elastic pawl portion cut, erected from the central portion into pressure contact against the outer side angle portion of the movable iron piece to pivotally support it. According to such present invention as described hereinabove, if the engagement arm portion of the hinge spring is dropped into the drop groove of the box-shaped base for engagement operation, the engagement leg portion is engaged with the engagement pawl portion of the spool, so that the hinge spring pivotally supports the movable iron piece on the horizontal tip end portion of the yoke, and also, the whole hinge spring is exposed sideways.

Therefore, as the exposed hinge spring may be easily removed with an instrument such as pincette or the like, the hinge spring may be easily engaged with and disengaged from the box-shaped base and the spool, so that the adjusting operation does not take much time as in the conventional embodiment. As a result, as the operation characteristics of the movable iron piece may be easily adjusted, the yield is improved, with an effect that the productivity is improved.

Also, in an electromagnetic relay, wherein an electromagnet portion is accommodated, secured within a box-shaped base having an upper opening portion to be opened at least upwardly, a terminal pressure insertion hole which vertically extends through is provided in the side wall of the box-shaped base, a terminal is inserted under pressure into the terminal pressure-insertion hole to form a contact mechanism portion, and also, the box-shaped case is covered on the box-shaped base for the engagement, a sealing agent is injected, hardened into the engagement portion to effect the sealing operation, the present invention is constructed so that the box-shaped base is vertically divided into two, an upper base portion and a lower base portion, the electromagnet portion is grasped integrally by the upper base portion and the lower base portion, also, a gap is provided between the upper base portion and the lower base portion. According to the present invention, as the upper base portion and the lower base portion vertically divided into two grasps the electromagnet portion into an integration, forming the given gap, the sealing agent does not enter deeply inside, because the gap is provided between the upper base portion and the lower base portion if the sealing agent is injected into the engagement portion, after the box-shaped case is covered on the base integrated through the grasping the electromagnet portion being grasped for the engagement operation, so that the sealing agent is not adhered on the contact mechanism portion and so on.

Accordingly, the stage difference is not required to be provided on the outer side face of the base as in the conventional embodiment, and the thickness of the side wall near the terminal pressure-insertion hole may be larger, the base is not failed at the terminal pressure-insertion to improve the support strength of the terminal.

Besides, the base may be vertically divided into two, the upper base portion and the lower base portion, with the respective height sizes being smaller. Thus, as the terminal pressure-insertion hole becomes shorter than that in the conventional embodiment, the metallic mold pin is hard to break.

Furthermore, as the upper base portion, the lower base portion may be molded by an upper, lower two division of metallic mold, a side core which has been used in the molding operation of the base in the conventional embodiment becomes unnecessary to simplify the molding operation.

And the electromagnet portion in accordance with the present invention may be mounted separately in the upper base portion and the lower base portion, and simultaneously is not necessary to be mounted, with an effect that the coil is hard to disconnect.

Furthermore, in order to achieve the above-described objects, according to the electromagnetic relay of the present invention, in an electromagnetic relay, wherein an electromagnet portion with one end portion of the iron core with the coil being wound around it being provided as a magnetic pole portion, and the other end portion being secured to the vertical portion of the yoke which is bent in an approximately L-shape in section is accommodated, secured within a box-shaped base having an upper opening portion to be opened upwardly, the contact mechanism portion formed through the pressure insertion of the terminal in the vertical direction into the side wall of the box-shaped base with an approximately L-shaped movable iron piece in section to be pivoted with the horizontal tip end portion of the yoke as a support point in accordance with the energization, deenergization of the electromagnetic portion, both the side edge portions of the yoke of the electromagnet portion are respectively engaged with, secured from the lower side to prevent the movable iron piece from being pulled out with one side portion of the box-shaped base and the horizontal tip end portion of the yoke. According to the present invention, as the movable iron piece is prevented from being pulled out by one side portion of the upper base portion and the horizontal tip end portion of the yoke, such a hinge spring as in the conventional embodiment becomes unnecessary.

Thus, not only the number of the parts, but also the number of assembling operations is reduced, so that the productivity is improved, with an effect that the cost is reduced.

Also, in order to achieve the above-described objects, according to the electromagnet apparatus of the present invention, in an electromagnet apparatus, wherein the projecting one end portion of the iron core with the coil wound around it is provided as a magnetic pole portion, while the vertical portion of the yoke bent into an approximately L-shape in section is secured onto the projecting other end, and also, the inner side face angle portion of the movable iron piece bent into an approximately L-shape in section is positioned, is pivotally supported on the upper angle portion of the tip end of the horizontal portion for forming the yoke, the upper face portion to be located near the tip end upper angle portion from the upper face of the horizontal portion for forming the yoke, and the lower face portion to be positioned near the inner side face angle portion from the inner side face of the movable iron piece are brought into face contact with respect to each other during the deenergization of the coil. According to the present invention, the contact area between the yoke and the movable iron piece during the deenergization (during the returning) increases.

Thus, the magnetic resistance between the yoke and the movable iron piece becomes smaller to improve the magnetic efficiency without the provision of a special member or the application of the special processing, if a constant impressed voltage exists the larger magnetomotive force is provided than the electromagnet apparatus in the conventional embodiment at the early stage of the driving operation.

Also, if the magnetomotive force which is the same as that of the electromagnet apparatus in the conventional embodiment is provided, the lower voltage has only to be impressed, so that the consumption power is reduced and also, the heating of the coil is reduced so as to reduce the deterioration of the apparatus to be caused through the temperature, with an effect that the reliability of the whole apparatus is improved.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein;

FIG. 1 is an exploded perspective view;

FIG. 2 is a plane sectional view;

FIG. 3 is a side sectional view;

FIG. 4 is a front sectional view;

FIG. 5 is a plan view of the base;

FIG. 6 is a sectional view taken along a line A—A of FIG. 5;

FIG. 7 is a sectional view taken along of a line B—B of FIG. 5;

FIG. 8 is a view for illustrating the assembling of the base and an electromagnet portion;

FIG. 9 is an exploded perspective view of a movable iron piece;

FIG. 10 is a perspective view of a hinge spring;

FIG. 11 is a perspective view of the spool;

FIG. 12 is an exploded perspective view showing an assembling method of the spool;

FIG. 13 is a partial broken perspective view showing the assembled spool;

FIG. 15 is an exploded perspective view;

FIG. 16 is a plane sectional face view;

FIG. 17 is a side sectional view;

FIG. 18 is a front sectional view;

FIG. 19 is a plane view of a base;

FIG. 20 is a sectional view taken along a line C—C of FIG. 19;

FIG. 21 is a sectional view taken along aline D—D of FIG. 19;

FIG. 22 is an exploded perspective view;

FIG. 23 is a plane sectional view;

FIG. 24 is a side sectional view;

FIG. 25 is a front sectional view;

FIG. 26 is an enlarged perspective view of a hinge spring;

FIG. 27 and FIG. 28 are essential-portions sectional views showing a method of assembling the hinge spring;

FIG. 29 is an exploded perspective view;

FIG. 30 is an side face sectional view of the fourth embodiment;

FIG. 31 is an exploded perspective view;

FIG. 32 is a plan face sectional view;

FIG. 33 is a side face sectional view;

FIG. 34 is a front face sectional view;

FIG. 35 is an essential portions enlarged view;

DETAILED DESCRIPTION OF THE INVENTION

(Embodiment 1)

Figure 1:
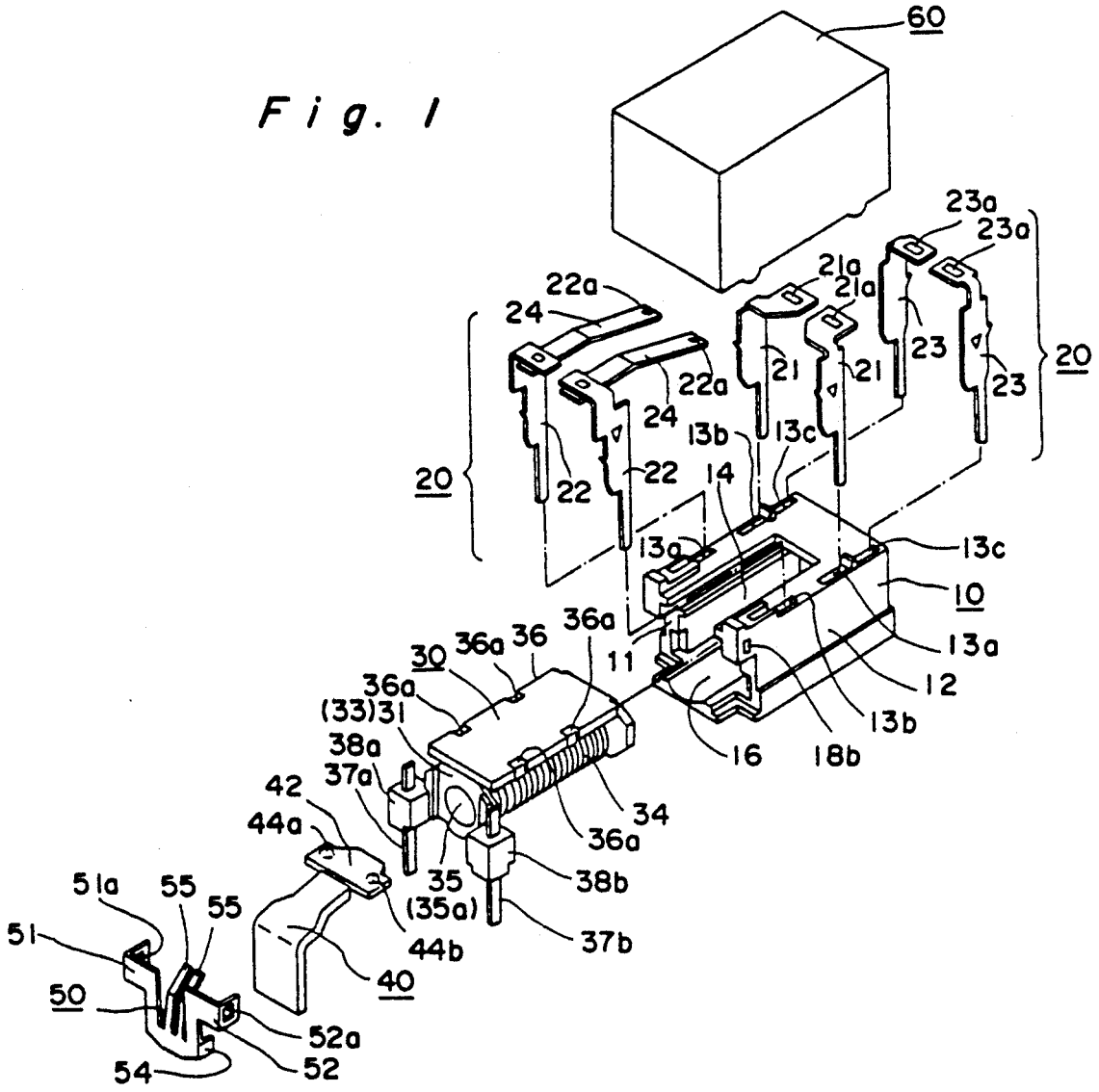
FIG. 1 through FIG. 10 show a first embodiment of the electromagnetic relay in accordance with the present invention.
Figure 2:
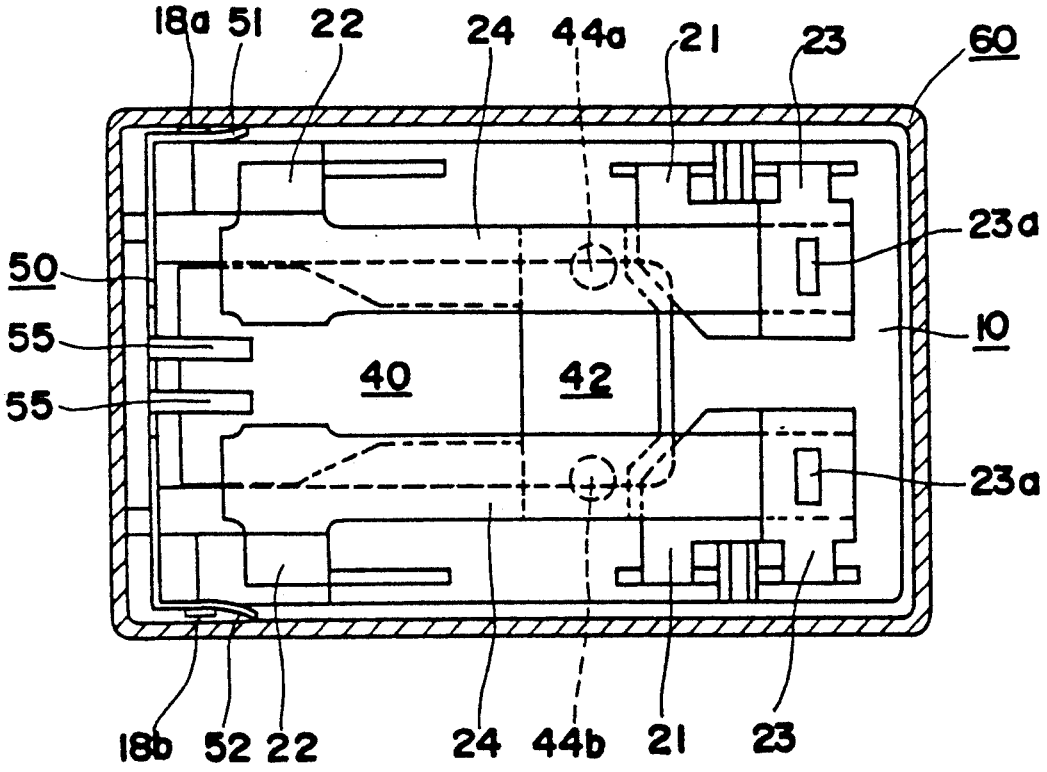

A first embodiment in accordance with the present invention will be described hereinafter with reference to the accompanying drawings of FIG. 1 through FIG. 10.

The electromagnetic relay in accordance with the first embodiment is roughly composed of a box-shaped base 10, a contact mechanism portions 20, 20, an electromagnet portion 30, a movable iron piece 40, a hinge spring 50 and a case 60.

Figure 6:
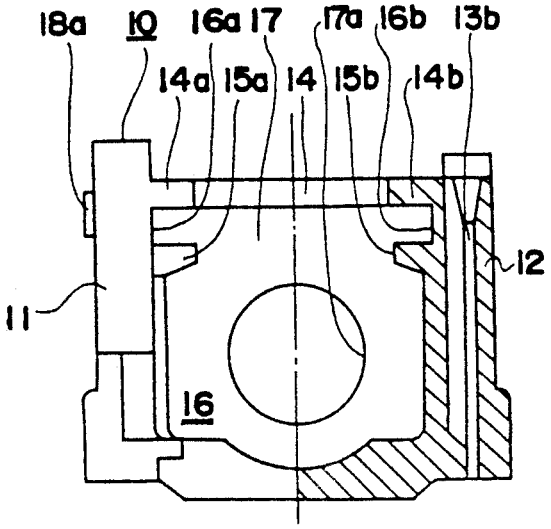
Figure 7:
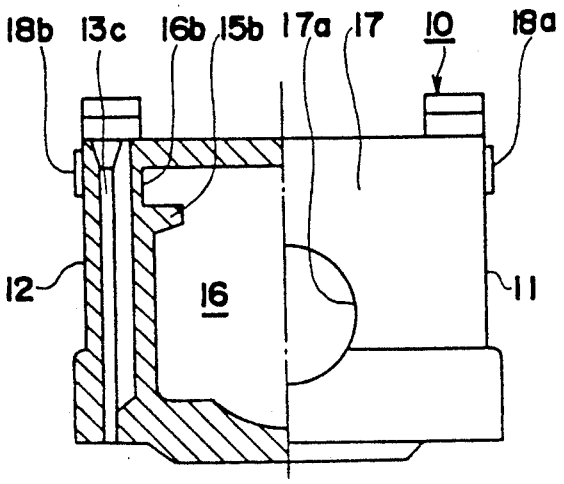

The box-shaped base 10 is approximately C-shaped in section, has respectively terminal holes 13*a*, 13*b*, 13*c* extending through in the upper, lower directions in the opposite side walls, guide grooves 16*a*, 16*b* communicated with the sideward opening portion 16 are formed by both the side edge portions 14*a*, 14*b* of the upper opening portion 14 and the rib portions 15*a*, 15*b* projected from the opposite inner side faces, and a through hole 17*a* is provided in the end face 17 (FIG. 6). The through hole 17*a* has a diameter larger than that of the end portion 35*b* of an iron core 35 to be described later.

Figure 8:
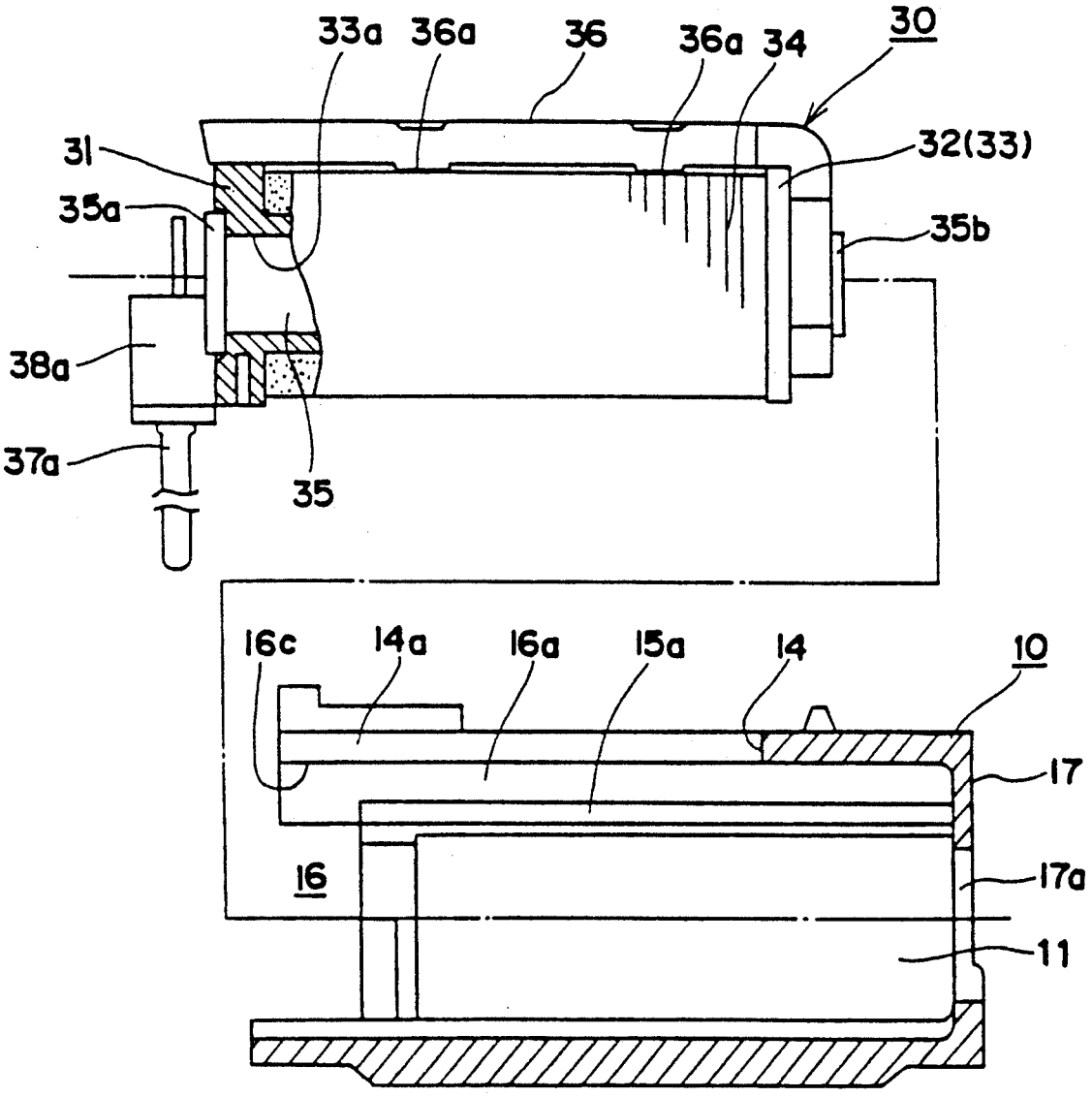

It is to be noted that one portion of the end portion facing the sideward opening portion 16 of the rib portions 15*a*, 15*b* is notched to provide a shorter stage difference than the edge portions 14*a*, 14*b* so as to expose the end portion lower face of the edge portions 14*a*, 14*b* (FIG. 8). This simplifies the positioning operation of the electromagnet portion 30 to be described later.

Furthermore, the projections 18*a*, 18*b* to be engaged with the hinge spring 50 to be described later are respectively projected from the portion to be positioned near the sideward opening portion 16 from the outer side faces of the opposing side walls 11, 12 of the box-shaped base 10.

The contact mechanism portions 20, 20 are provided in parallel on both the side edge portions of the top face of the base 10 through the respective pressure-insertion of a normally-closed fixed contact terminal 21, a movable contact terminal 22 and a normally-open fixed contact terminal 23 into the terminal holes 13*a*, 13*b*, 13*c* of the box-shaped base 10.

Figure 3:
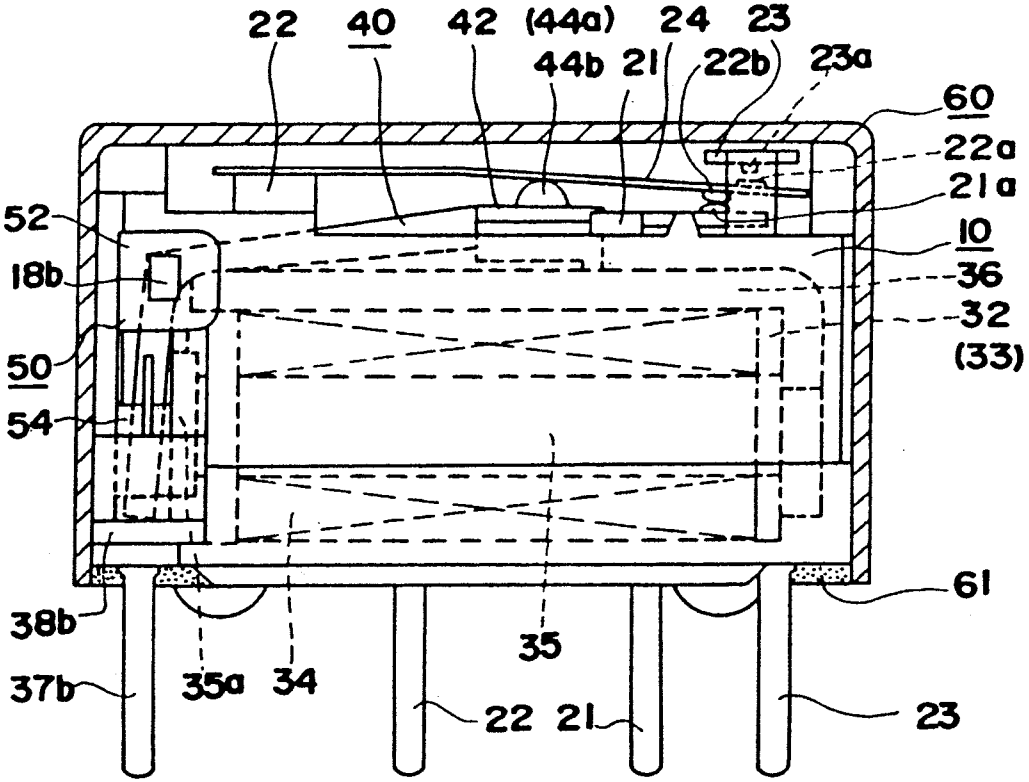
Figure 4:
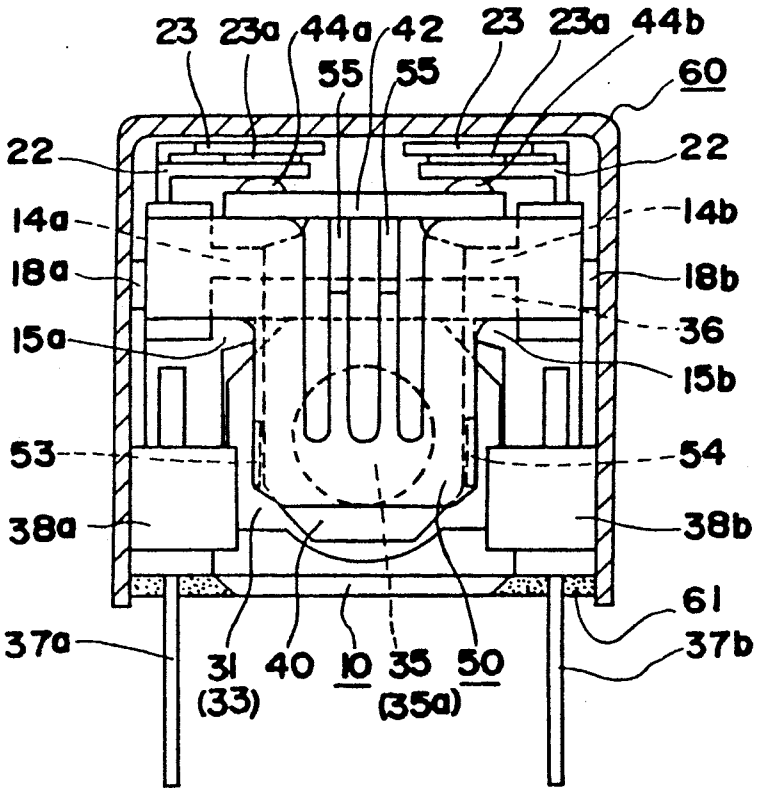
Figure 5:
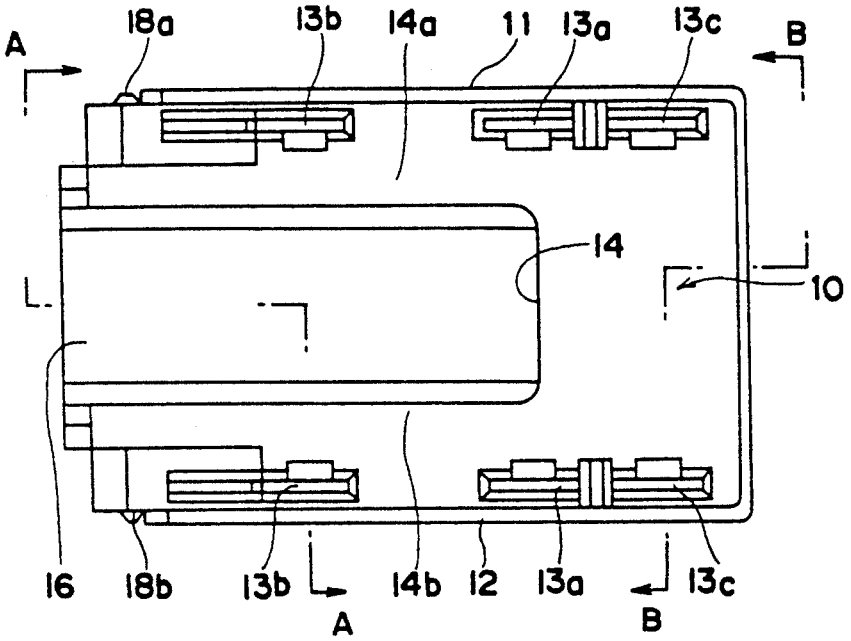

In particular, the movable contact terminal 22 has one end portion of the movable contact piece 24 welded to the upper portion thereof, the movable contact piece 24 has movable contacts 22*a*, 22*b* to be disengageably coupled alternately to the normally-closed fixed contact 21*a* of the normally-closed fixed contact terminal 21 and the normally-open fixed contact 23*a* of the normally-open fixed contact terminal 23 provided respectively on the front, reverse faces of the free end portion thereof (FIG. 3).

As the respective contact terminals 21, 22, 23 are secured to the base 10 through the press fitting, the same type of contacts on both the sides located in the mutually opposing positions may be adjusted in height to become the same in level by the variation in the respective pressing engagement. Also, the adjustment of the contact pressure with respect to the movable contact 22*a* may be effected by the variation in the pressing engagement of the normally-closed fixed contact terminal 21, the adjustment of the contact interval with respect to the movable contact 22*a* may be effected by the variation in the pressing engagement of the normally-open fixed contact terminal 23, furthermore the gap adjustment with respect to the projections 44*a*, 44*b* of the card 42 of the movable iron piece 40 may be effected by the variation in the pressing engagement of the movable contact terminal 22.

It is to be noted that among the terminals constructing the contact mechanism portion 20, the normally-closed fixed contact terminal 21 may be insert-molded in advance on the box-shaped base 10, also, the normally-closed fixed contact terminal 21, the movable contact terminal 22 and the normally-open fixed contact terminal 23 may be molded integrally with resin to constitute a contact block, and this may be fixedly press-fitted into the base 10.

As shown in FIG. 8, in the electromagnet portion 30, the coil 34 is wound around the spool 33 having flange portions 31, 32 at both the end portions, and also, the iron core 35 of an approximately T-shape in section is inserted into the central hole 33*a* of the spool 33 so as to provide the projecting one end portion as a magnetic pole portion 35*a*, while the projecting other end 35*b* is crimped fixedly to the vertical portion of the yoke 36 bent into an approximately L-shape in section.

The spool 33 has pedestal portions 38*a*, 38*b*, with coil terminals 37*a*, 37*b* being insert-molded in it, extended into both the side edge portions of the flange portion 31.

Also, the projection portions 36*a*, 36*a* are provided by a protrusion processing operation is provided on both the side edge portions of the horizontal portion of the yoke 36.

Accordingly, the outer side angle portion of the yoke 36 is brought into contact obliquely from below against the end portion lower faces 16*c* of the edge portions 14*a*, 14*b* facing the sideward opening portion 16 of the base 10 to effect the positioning operation, and thereafter both the side edge portions of the yoke 36 are inserted into the guide grooves 16*a*, 16*b* to press-contact the projections 36*a*, 36*a* of the yoke 36 with the guide grooves 16*a*, 16*b* to press-fit them, so that the other end portion 35*b* of the iron core 35 crimped to the yoke 36 is engaged into the through hole 17*a* to bring the vertical portion of the yoke 36 against the end face 17 of the base 10. Thus, there is an advantage that the dead space is not caused.

Also, according to the first embodiment, as the edge portions 14*a*, 14*b* and the stage difference are provided by partially notching the end portions of the rib portions 15*a*, 15*b* in the positioning of the electromagnet portion 30, the outer side face angle portion of the yoke 36 is brought into contact against the end portion lower faces 16*c* of the edge portions 14*a*, 14*b* for the purpose of facilitating the correct positioning and the assembling operation, with an advantage that the wire is hard to disconnect without the coil 4 being caught in the edge portion of the sideward opening portion 16 of the base 10.

Furthermore, as the electromagnet portion 30 is directly pressure-inserted fixedly into the guide grooves 16*a*, 16*b* of the base through the projections 36*a*, 36*a* of the yoke 36, there is an advantage that the electromagnetic portion 30 may be strictly engaged with the base with high accuracy and without any play.

Furthermore, when the electromagnet portion 30 is disengaged from the base 10, it may be disengaged from by simply pushing out the iron core 35 from the through hole 17*a*, so that the pedestal portions 38*a*, 38*b* and so on of the spool 33 are not required to be pulled, with an advantage that the spool 33 and so on are hard to damage.

Figure 9:
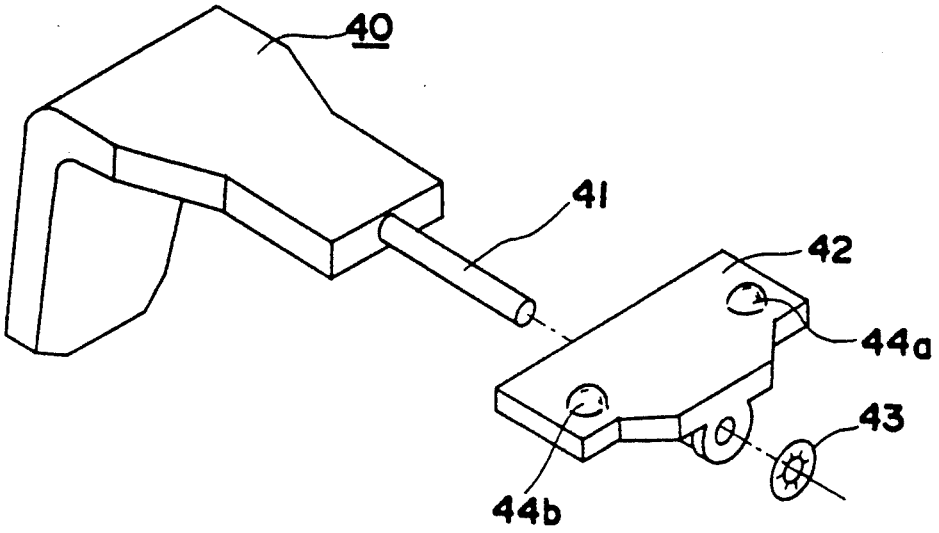

As the movable iron piece 40 is composed of a punched-out metallic plate bent into an approximately L-shape in section, a card 42 is pivotally supported on a shaft portion 41 provided at the horizontal tip end portion thereof, with a stop ring 43 preventing the card 42 from being pulled off (FIG. 9). And the top surface of the card 42 is provided with projections 44*a*, 44*b* which may come into contact against the central portions of the under surfaces of the movable contact pieces 24, 24.

Accordingly, when the card 42 of the movable iron piece 40 is inserted between the movable contact pieces 24, 24 and the edge portions 14*a*, 14*b* of the base 10, the movable iron piece 40 is positioned between the edge portions 14*a* and 14*b*, the inner side face angle portion thereof is supported by the hinge with the tip end angle portion of the yoke 36 being in contact against it, and also, the vertical portion of the movable iron piece 40 may be disengageably coupled to the magnetic pole portion 35*a* of the iron core 35.

Figure 10:
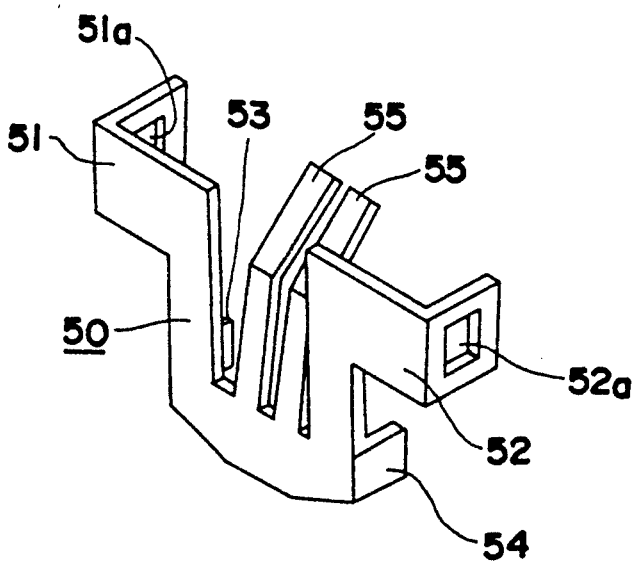

The hinge spring 50 has a plan face shape almost similar to the vertical portion of the movable iron piece 40, a pair of opposing arm portions 51, 52 are cut out upwardly of both the side portions, and also, a pair of opposing tongue pieces 53, 54 are cut out downwardly of the either side thereof (FIG. 10). Further, the hinge spring 50 has a pair of pawl portions 55, 55 which are punched out in the central portion thereof and are bent.

Thus, the engagement holes 51*a*, 52*a* provided in the arm portions 51, 52 are respectively engaged with the projections 18*a*, 18*b* of the base 10 to bring the pawl portions 55, 55 into pressure contact against the outer side face angle portion of the movable iron piece 40, the movable iron piece 40 is pivotally supported by the hinge, and also, the tongue pieces 53, 54 regulate in position both the side end faces of the movable iron piece 40 to prevent the play in the axial direction, thus preventing the abrasion powder from being caused through the friction against the base 10.

Further, the tongue pieces 53, 54 of the hinge spring 50 come into contact against the outer side face of the flange portion 31 to cause a gap between the hinge spring 50 and the vertical portion rear face of the movable iron piece 40. Therefore, if a bending moment is caused in the hinge spring 50 in accordance with the reaction of the pawl portions 55, 55 depressing the outer side face angle portion of the movable iron piece 40, the bending moment is applied upon the tongue pieces 53, 54 not to give influences to the operation of the movable iron piece 40, with an advantage that the defective operation is not caused in the movable iron piece 40.

The case 60 has an approximately box-shape which is engageable with the base 10, and has a sealing agent 61 injected, hardened sealingly after having been engaged with the base 10.

The operation of the electromagnetic relay in accordance with the present embodiment will be described hereinafter.

In the case of the deenergization, the card 42 is pressed down by the spring force of the movable contact pieces 24, 24, so that the vertical portion of the movable iron piece 40 is open away from the magnetic pole portion 35*a* of the iron core 35, while the movable contact point 22*b* closes the normally-closed fixed contact 21*a*.

And when the coil 34 is energized, the vertical portion of the movable iron core 40 is attracted to the magnetic pole portion 35*a* of the iron core 35, the movable iron piece 40 pivots with the tip end angle portion of the yoke 36 as a support point against the spring force of the movable contact pieces 24, 24, the projections 44*a*, 44*b* of the card 42 push up the movable contact pieces 24, 24 to open away the movable contact 22*b* from the normally-closed fixed contact 21*a*, thereafter the movable contact 22*a* closes the normally-open fixed contact 23*a*.

Then, when the energization of the coil 34 is released, the movable iron piece 40 is pivoted by the spring force of the movable contact pieces 24, 24 to be restored into the original condition.

According to the present embodiment, as the projections 44*a*, 44*b* of the card 42 push up the under faces of the movable contact pieces 24, 24 in an almost point contact condition, the side end portions of the movable contact pieces 24, 24 do not come into uneven contact against the card 42, the abrasion powder is not caused if the movable contact pieces 24, 24 are mounted in a twisted condition or the card 42 is in contact in an inclined condition.

Also, since the card 42 is pivotally supported by the movable iron piece 40, the card 42 comes into contact with the movable contact pieces 24, 24 simultaneously if a variation exists in the positioning accuracy of the movable contact pieces 24, 24, with an advantage that the variation is not caused in the opening, closing operations of the contact point.

Further, in the above-described embodiment, a case where two units of contact mechanism portions are provided above the electromagnet portion is described, it is needless to say that one unit of contact mechanism portion may be provided without being limited thereby to it.

As clear from the above-described description, according to the electromagnetic relay of the first embodiment, since the positional accuracy is better with respect to the base of the electromagnetic portion, and the positioning of the contact mechanism has only to be changed in the pressing engagement of each terminal thereof, there is an effect that the adjustment of the related position between the contact mechanism and the electromagnet block is easier to effect.

Figure 12:
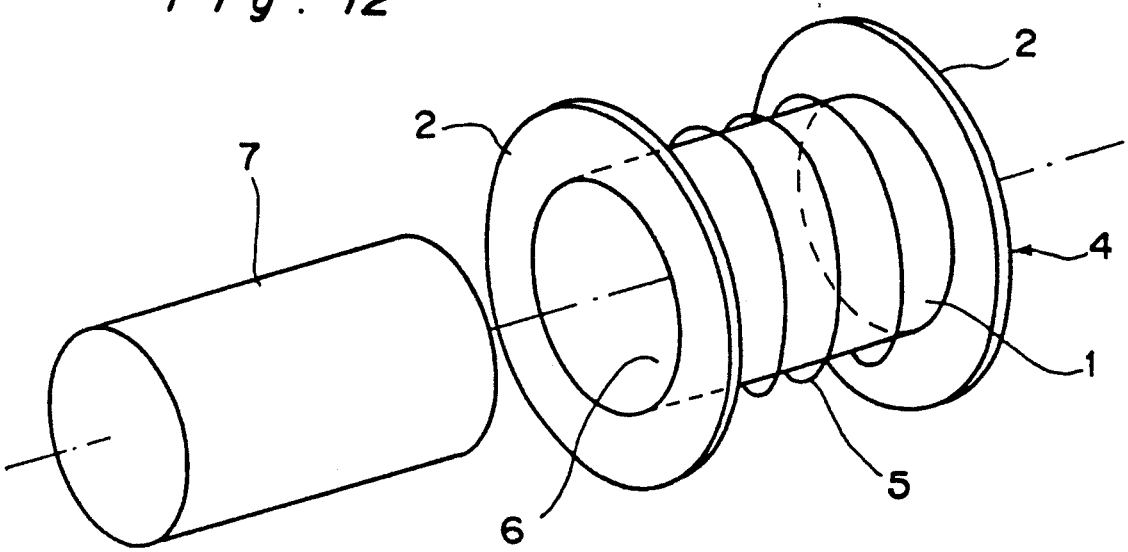
Figure 13:
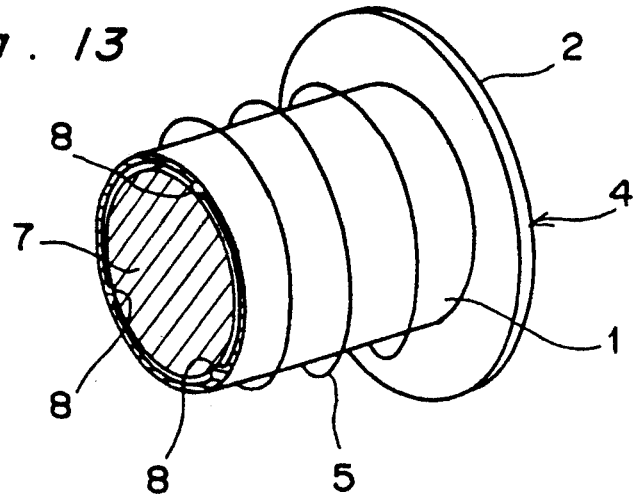
Figure 15:
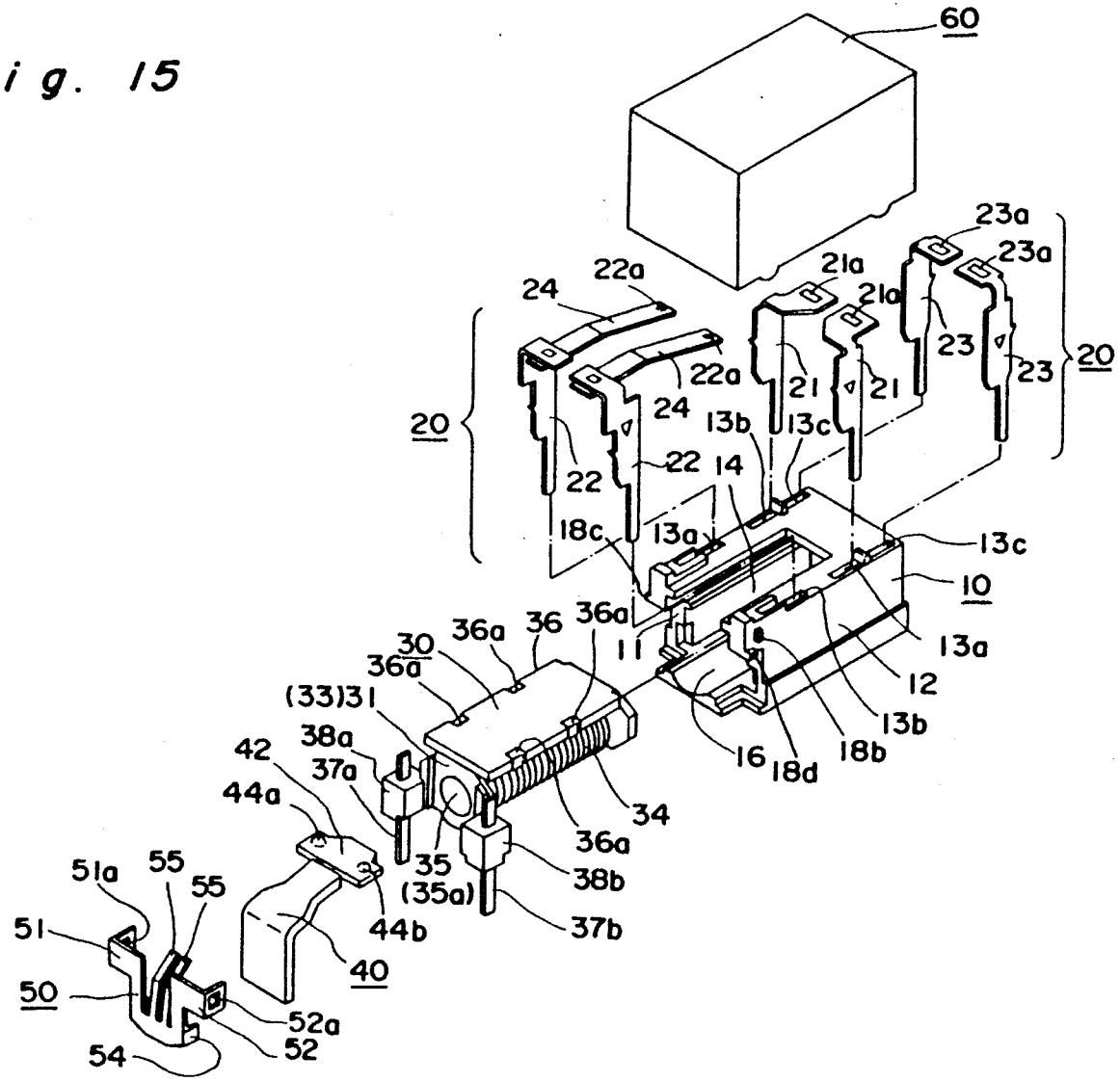
FIGS. 15 through 21 show a second embodiment of the electromagnetic relay in accordance with the present invention.
Figure 16:
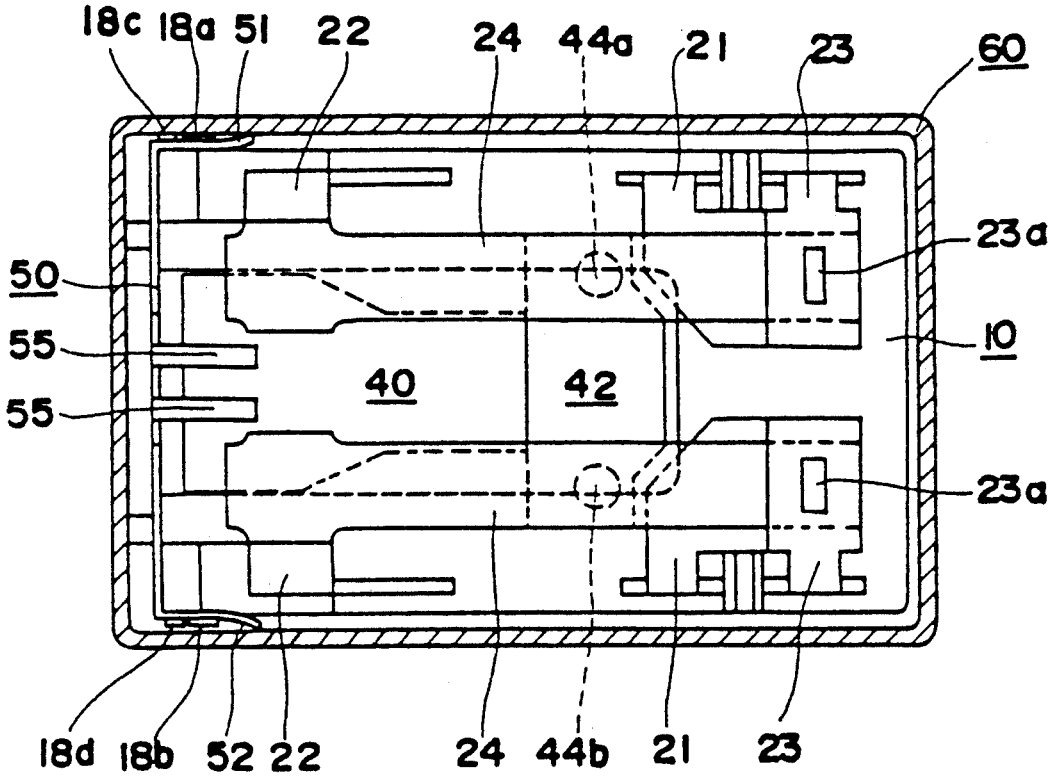
Figure 17:
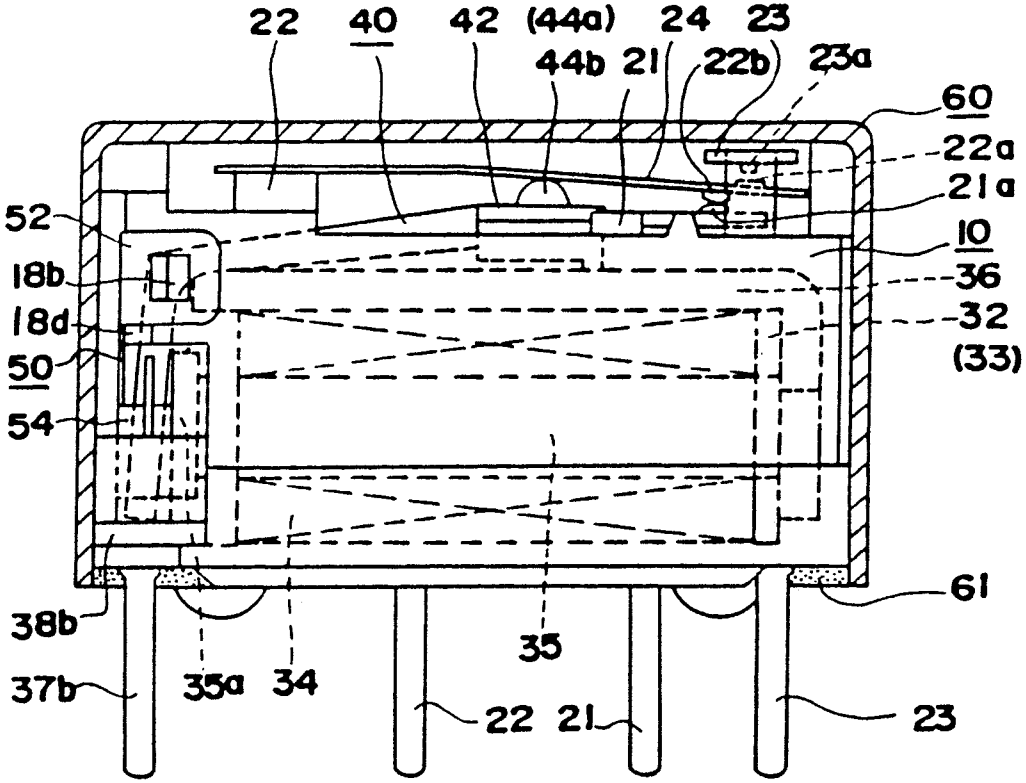
Figure 18:
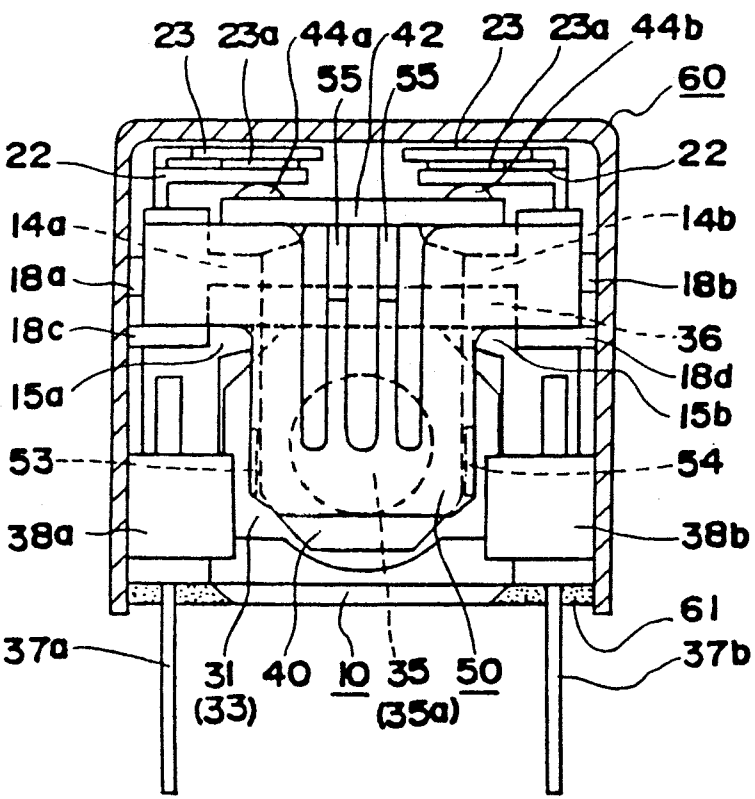
Figure 19:
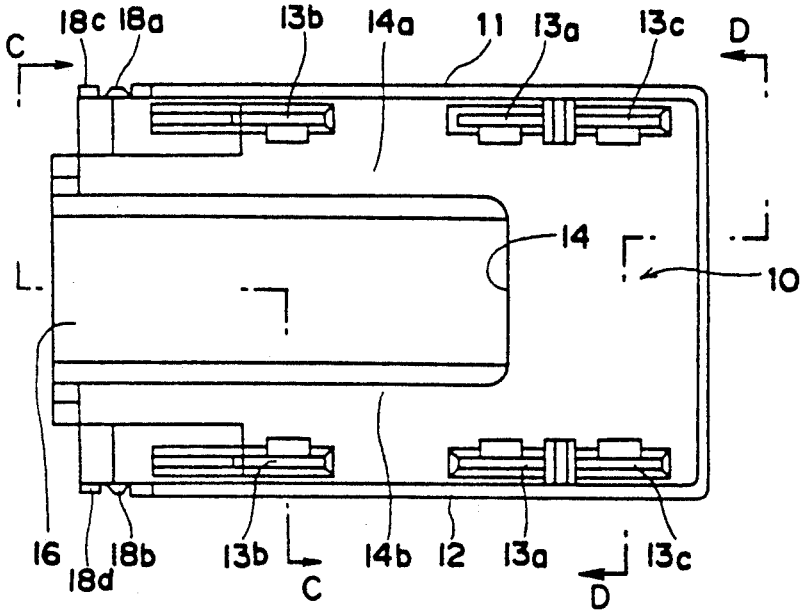
Figure 20:
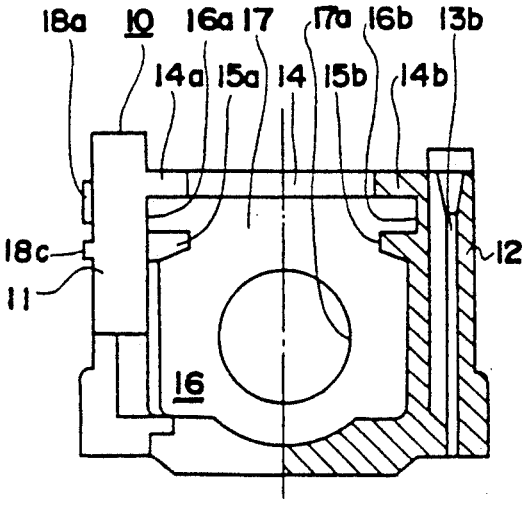
Figure 21:
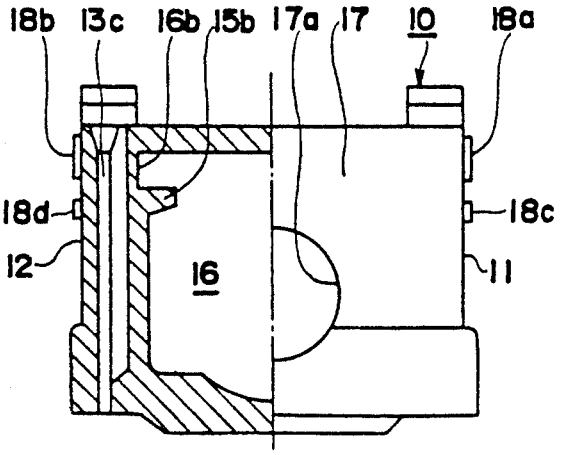
Figure 22:
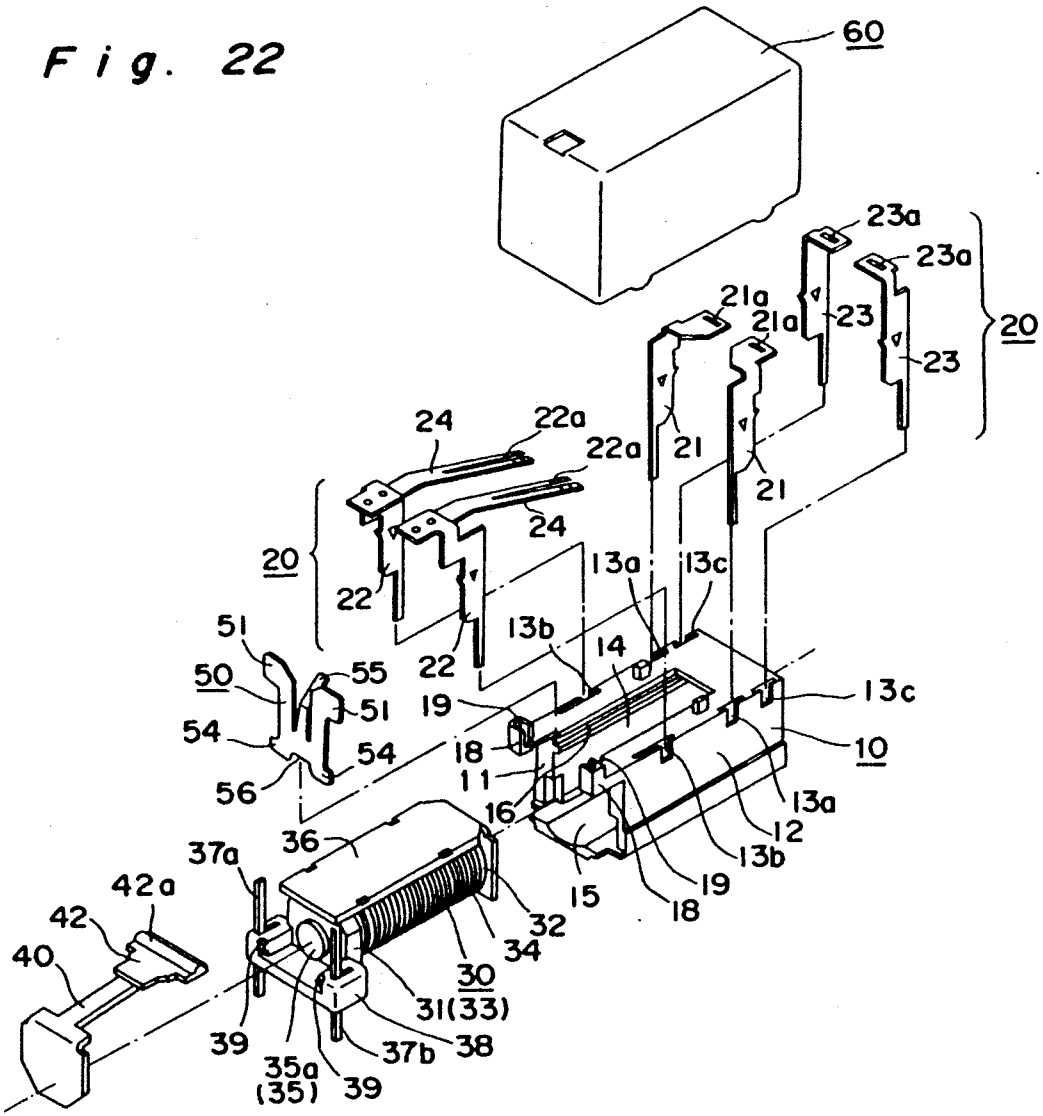
FIG. 22 through FIG. 28 show a third embodiment of an electromagnetic relay in accordance with the present invention.
Figure 23:
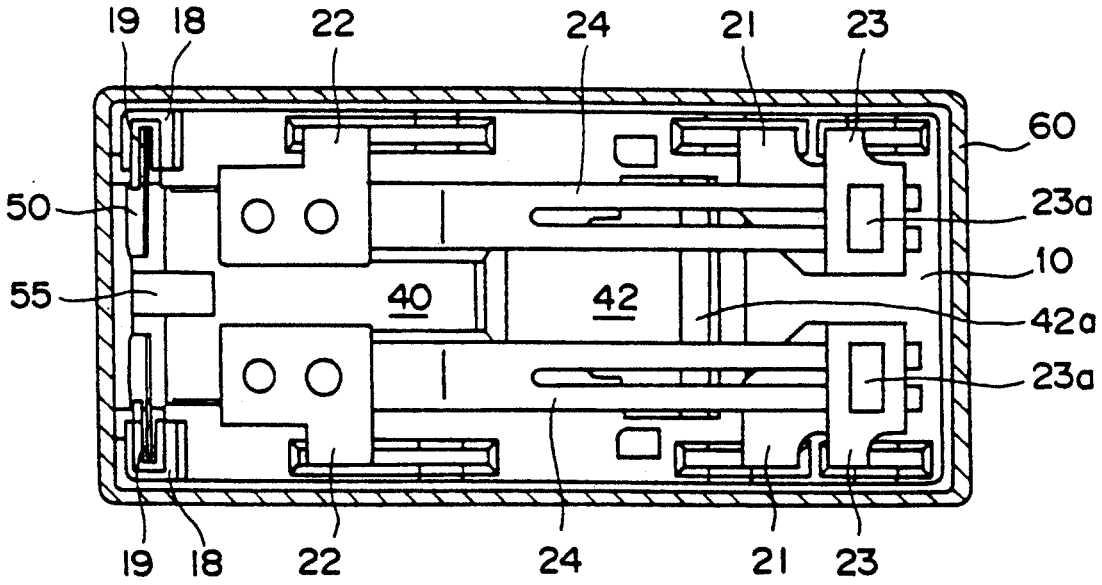

The modified embodiment of the spool in accordance with the present invention will be described hereinafter with reference to accompanied drawings of FIG. 11 through FIG. 13.

The electromagnet apparatus in accordance with the present modified embodiment is composed of a spool 4 made of profile memory synthetic resin having flange portions 2, 2 at both the end portions of the barrel portion 1, a coil 5 wound around the barrel portion 1 of the spool 4, an iron core 7 inserted into the through hole 6 provided in the barrel portion 1.

Figure 11:
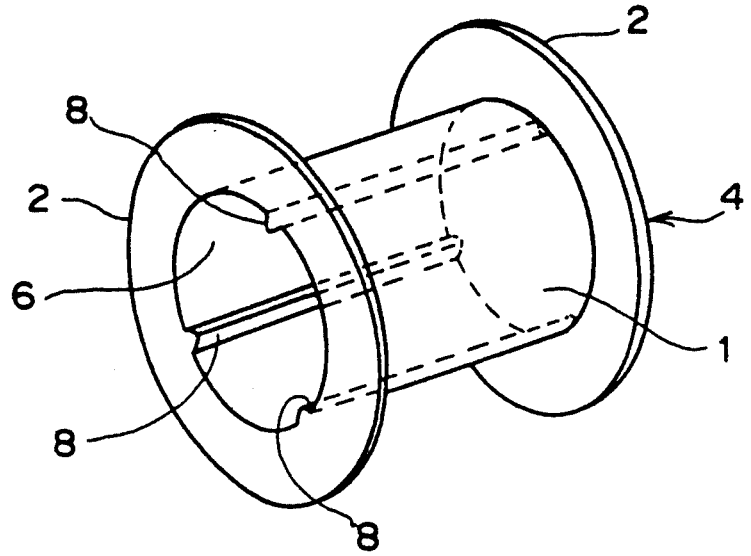
FIG. 11 to FIG. 13 show a modification of a spool in accordance with the first embodiment.

Since three pressure contact projection portions 8 of the spool 4 are projected at equal intervals in an axial direction from the inner peripheral face of the through hole 6, the profile is memorized (FIG. 11). And the spool 4 depresses the inner peripheral face of the through hole 6 to deform the pressure contact projection portion 8 so as to turn the inner peripheral surface of the through hole 6 into the smooth face.

Therefore, after the coil 5 has been wound around the barrel portion 1 of the spool 46, the iron core 7 is inserted into the mold through hole 6 for heating purpose, and the deformed pressure contact projection portion 8 is restored into the original shape to press upon the outer peripheral face of the iron core 7 to restrict the iron core 7 from being pulled out.

According to the modified embodiment, since the pressure contact projection portion 8 is not projected, and the inner peripheral surface of the through hole 6 is smooth when the iron core 7 is inserted through the through hole 6 of the spool 4, the insertion of the iron core 7 does not take much time, and also, the iron core 7 does not cut the pressure contact projection portion 8, with an advantage of eliminating the possibility of causing cutting shavings.

Further, although a case wherein three pressure contact projection portions provided at the equal intervals in the axial direction are provided from the inner peripheral face of the through hole 6 in the above-described modified embodiment is explained, the pressure contact projection portion will do if it is at least one without being restricted thereby to it, and also, it may be formed in a ring shape along the inner peripheral face thereof.

Further, the shape of the inner peripheral face is not restricted to a case wherein the projections are provided, but, for example, the opening portion of the through hole after the shape has been restored may be oval in shape, or after a metallic mold of a conical pedestal shape is press-fitted into the through hole of a true circle to give some deformation to the inner peripheral face, thereafter the iron core may be inserted for the heating purpose so that the iron core may be prevented from being pulled out from the through hole of the spool.

On one hand, the iron core may be a rod-shaped member square in section without being limited thereby to a circle shape in section, and the through hole may be also square-shaped in section correspondingly as a matter of course.

Figure 14:
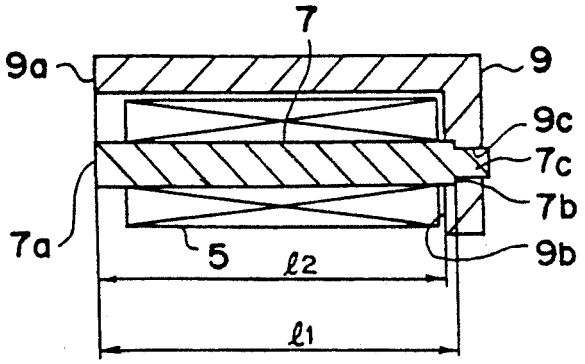
FIG. 14 is a sectional view of a modification of the electromagnet in accordance with the first embodiment.

One modified embodiment of the electromagnet of the present invention will be described hereinafter with reference to FIG. 14.

The electromagnet shown in FIG. 1 has the length l1 of the iron core 1 which is larger than the length l2 of the yoke 2, with the yoke 2 being relatively lower in hardness than the iron core 1.

The method of reducing the relative hardness with respect to the iron core 7 of the yoke 9 is considered in the following.

(i) The yoke 9 and the iron core 7 are made of the same in material, and the heat treatment is applied on at least either of them. For example, the yoke 9 is annealed and the iron core 7 remains untreated.

(ii) The hardness is varied with the same material. For example, a rolling ratio of the material is varied.

(iii) Different types of materials which are different in hardness are used. For example, electromagnetic soft iron is used for the yoke 9, silicon steel plate is used for the iron core 7.

Then, the electromagnet in accordance with the present modified embodiment is manufactured as follows.

First, a coil 5 is wound around a step iron core 7, continuously a projection portion 7*c* of the iron core 7 is engaged with an engagement portion 9*c* of the yoke 9, then the iron core 7 or the yoke 9 are stricken with impacts in the longitudinal direction so that the magnetic pole face 7*a* of the iron core 7 may be flush the tip end face 9*a* of the yoke 9.

At this time, as the yoke 9 has hardness relatively lower than the iron core 7, the step portion 7*b* of the iron core 7 sinks into the iron core fixed portion inner face 9*b* of the yoke 9, so that the gap is not caused between the stage portion 7*b* and the iron core fixed portion inner face 9*b*, and the iron core 7 does not cause the buckling.

And the tip end of the iron core 7 projected from the iron core fixed portion outer face is crimped to secure the yoke 9. As clear from the above-described description, the electromagnet in accordance with the present modified embodiment is not reduced in the absorption force, because the gap between the stage portion of the iron core and the iron core fixed portion inner face of the yoke is removed to reduce the magnetic loss, with a result that the magnetic efficiency is improved. Also, as the buckling of the iron core does not exist, the inclination of the magnetic face of the iron core and the failure of the coil may be prevented to extend the life service. Further, as the iron core and the yoke are different in length, the manufacture size tolerances of these products may be relaxed, the price becomes lower, thus improving the productivity.

Embodiment 2

The second embodiment in accordance with the present invention will be described hereinafter with reference to accompanying drawings of FIG. 15 through FIG. 21.

The parts which are the same as in the electromagnetic relay in accordance with the first embodiment are provided with the same numerals so as to omit the description thereof.

The box-shaped base 10 is provided with guide projections 18*c*, 18*d* for guiding the arm portions 51, 52 of the hinge spring 50 as mentioned earlier from a portion to be positioned near the side opening portion 16, and also, is provided with engagement projections 18*a*, 18*b* which may be engaged into the engagement holes 51*a*, 52*a* provided in the elastic arm portions 51, 52 of the hinge spring 50 near the guide projections 18*c*, 18*d*. The engagement projections 18*a*, 18*b* have inclined faces for the purpose of facilitating the engagement of the hinge spring 50 as mentioned earlier (FIG. 19).

The contact mechanism portions 20, 20 are provided in parallel on both the side edge portions of the top face of the base 10 through the respective press-fittings operations of the normally-closed fixed contact terminal 21, the movable contact terminal 22 and the normally-closed fixed contact terminal 23 into the terminal holes 13*a*, 13*b*, 13*c* of the box-shaped base 10.

Therefore, after the elastic arm portions 51, 52 are brought into contact against the guide projections 18*c*, 18*c* provided on the outer side faces of the opposing side walls 11, 12 of the base 10 and are positioned, a pressure is applied along the guide projections 18*c*, 18*d* so as to cause the tip end edge portions of the elastic arm portions 51, 52 to come into contact against the inclined faces of the engagement projections 18*c*, 18*d* to be pushed wider, the engagement holes 51*a*, 52*a* of the elastic arm portions 51, 52 are respectively engaged with the engagement projections 18*c*, 18*d* of the base 10, so that the elastic pawls 55, 55 depress the outer side face angle portion of the movable iron piece 40 in the plate thickness direction so as to pivotally support the movable iron piece 40 in a manner of hinge, and also, the tongue pieces 53, 54 come into contact against both the side end portions of the movable iron piece 40 to effect the positional regulation of the width direction to prevent the play of the movable iron piece 40 in the width direction so as to prevent the abrasion powder from being caused through the friction between both the side end portions of the movable iron piece 40 and the edge portions 14*a*, 14*b* of the base 10.

As clear from the above-described description, according to the second embodiment, simply by contacting the elastic arm portion of the hinge spring against the guide projection provided on the outer side face of the opposing side wall of the box-shaped base so as to push it in, the engagement hole provided in the elastic arm portion of the hinge spring is engaged with the engagement projection provided in the box-shape base, so that the mounting operation of the hinge spring is simplified to improve the productivity as an effect.

Embodiment 3

A third embodiment in accordance with the present invention will be described hereinafter with reference to accompanying drawings of FIG. 22 through FIG. 28.

The parts which are the same as in the first embodiment will be provided with the same numerals so as to omit the description thereof.

The electromagnetic relay in accordance with the third embodiment of the present invention is roughly composed of a box-shaped base 10, a contact mechanism portions 20, 20, an electromagnet portion 30, a movable iron piece 40, a hinge spring 50 and a case 60.

Figure 24:
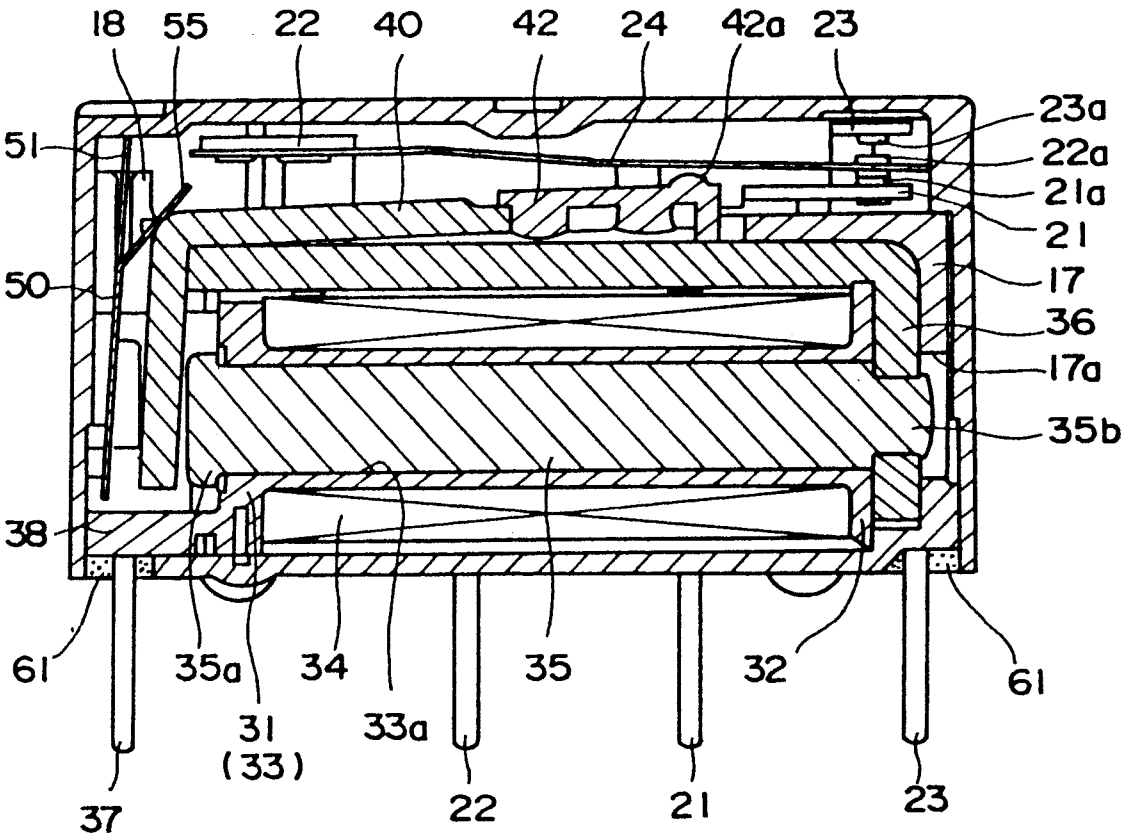
Figure 25:
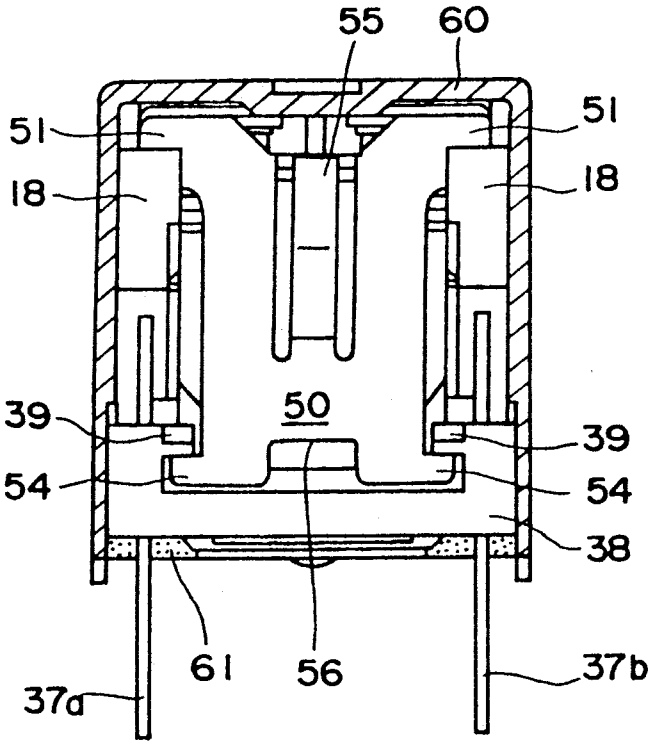

The box-shaped base 10 is an approximately C-shape in section, and respectively has the terminal holes 13*a*, 13*b*, 13*c* passing through in the upper, lower directions in the opposing side walls 11, 12, respectively forms a pair of guide grooves 16 (the guide groove on this side is not shown) communicating with the sideward opening portion 15 on both the side edge portions of the upper opening portion 14, and also, a through hole 17*a* is provided in the end face 17 (FIG. 24). The through hole 17*a* has a diameter which allows the end portion 35*b* of the iron core 35 may be engaged.

Further, the box-shaped base 10 is respectively projected from the side end face upper portions of the opposite side walls 11, 12 with the arm portion 18 being provided sideways, further the arm portion 18 is provided with a drop groove 19 into which the engagement arm portion 51 of the hinge spring 50 is engaged.

The spool 33 extends a pedestal portion 38 sideways from the outer side face lower end portion of the flange 31, insert-molds a coil terminal 37 on both the side edge portions of the pedestal portion 38, and also, projects sideways a pair of engagement pawl portions 39 the engagement leg portion 52 of the hinge spring 50 to be described later is engaged with. Also, the press forming operation is applied upon both the side edge portions of the horizontal portion of the yoke 36.

Accordingly, after abutting the outer side face angle portion of the yoke 36 to the sideward opening portion 15 of the base 10 obliquely from below so as to effect the positioning operation, both the side edge portions of the yoke 36 are slit into the guide groove 16 so as to effect a press-fitting operation thereinto, the other end portion 35*b* of the iron core 35 is engaged into the through hole 17*a* to contact the vertical portion of the yoke 36 against the end face 17 of the base 10.

Thus, according to the present third embodiment, since the dismantling operation may be easily effected simply by the pushing out the iron core 35 from the through hole 17*a* when the electromagnet portion 30 is removed from the base 10, the pedestal portion 38 of the spool 33 or the like is not required to be pulled, with an advantage of eliminating the possibility of damaging the spool 33 and other parts.

The movable iron piece 40 is a punched-out metallic plate which is bent into an approximately L-shape in section, with the card 42 being fixedly heat-crimped to the horizontal tip end portion thereof (FIG. 3). And the top face of the card 42 is provided with a projection 42*a* above, which may come into contact against the movable contact pieces 24, 24.

Therefore, when the card 42 of the movable iron piece 40 is inserted between the movable contact pieces 24, 24 and the base 10, the inner side face angle portion of the movable iron piece 40 comes into contact against the horizontal tip end angle portion of the yoke 36 so as to be supported in a manner of hinge, and also, the vertical portion of the movable iron piece 40 may move toward and away from the magnetic pole portion 35*a* of the iron core 35.

Figure 26:
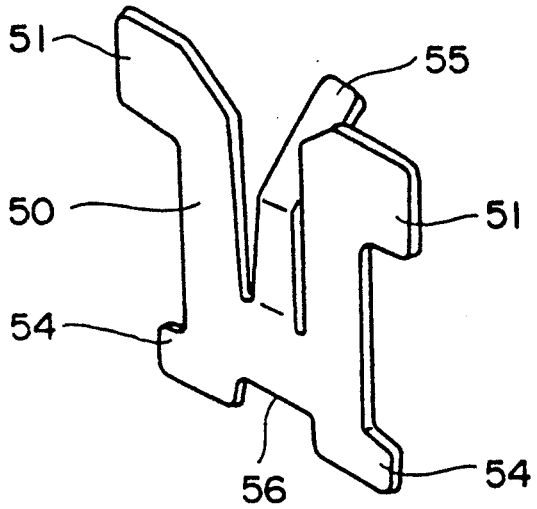
Figure 27:
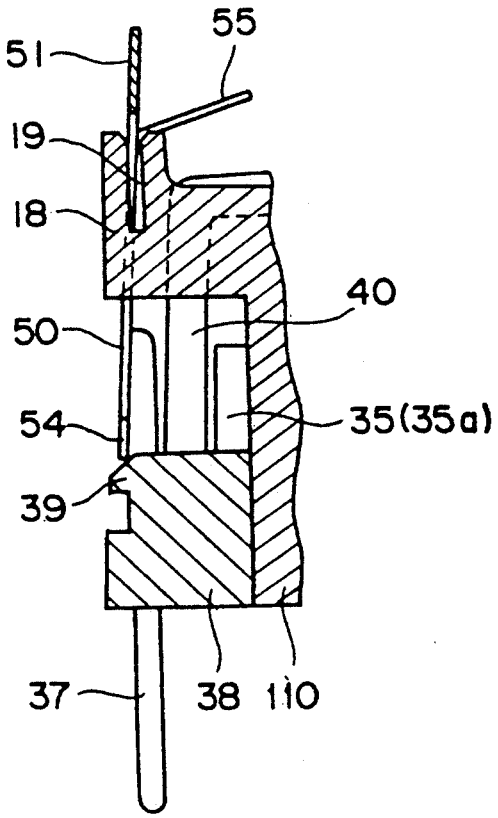

The hinge spring 50 is made of a leaf spring having a plan face which is almost the same in shape as the vertical portion of the movable iron piece 40, is provided with a pair of engagement arm portions 51, 51 respectively projected sideways from the both the side upper portions, and also, a pair of engagement arm portions 54 are respectively projection sideways from both the side lower portions (FIG. 26). Further, the hinge spring 50 has an elastic pawl portion 55 cut out from the central portion thereof, and also, has a notched portion 56 at the lower end portion.

Figure 28:
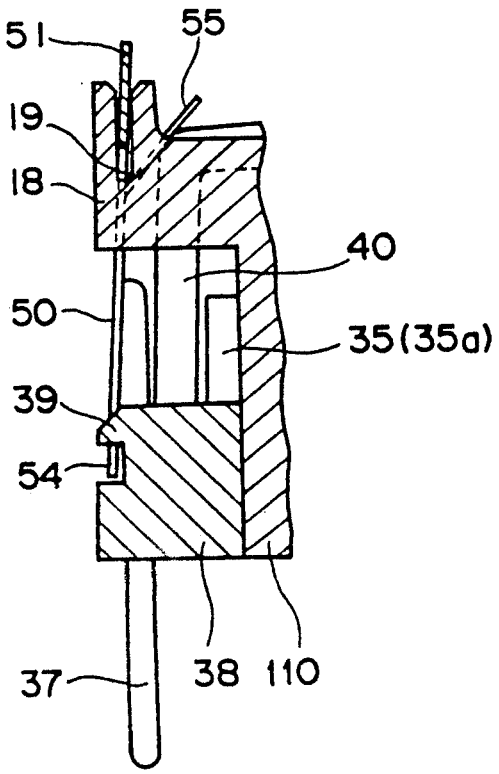

Thus, when the engagement arm portions 51, 51 are respectively dropped from above into drop grooves 19 provided in the arm portion 18 of the base 10 so as to engage them (FIG. 27), the hinge spring 50 is regulated in position in the plate thickness direction, so that the engagement leg portion 54 goes over the engagement pawl portion 39, effecting the elastic deformation to engage it, and the elastic pawl portion 55 applies pressures against the outer side face angle portion of the movable iron piece 40 in the plate thickness direction to pivotally effect the supporting operation in a manner of hinge (FIG. 28).

Since the whole hinge spring 50 is exposed when the desired operation characteristics are not obtained in the present embodiment (FIG. 24), insert an adjusting jig such as pincette or the like into a notch portion 56 provided at the lower end portion thereof, and it may be easily removed. Therefore, the adjusting operation does not take much time, with better yield being provided, thus resulting in higher productivity as an advantage.

Further, the engagement arm portion 51 of the hinge spring 50, and the engagement leg portion 54 are respectively engaged into the drop groove 19 of the box-shaped base 10 and the engagement pawl portion 39 of the spool 33, so that the hinge spring 50 forms a gap with respect to the vertical portion rear face of the movable iron piece 40 (FIG. 24). Thus, if the bending moment is caused in the hinge spring 50 in accordance with the reaction of the elastic pawl portion 55 by which the outer side face angle portion of the movable iron piece 40 is depressed in the plate thickness direction, the bending moment is received by the engagement arm portion 51, the engagement leg portion 54 without affecting the operation of the movable iron piece 40, with an advantage of eliminating the possibility of the failure in the operation.

Embodiment 4

Figure 29:
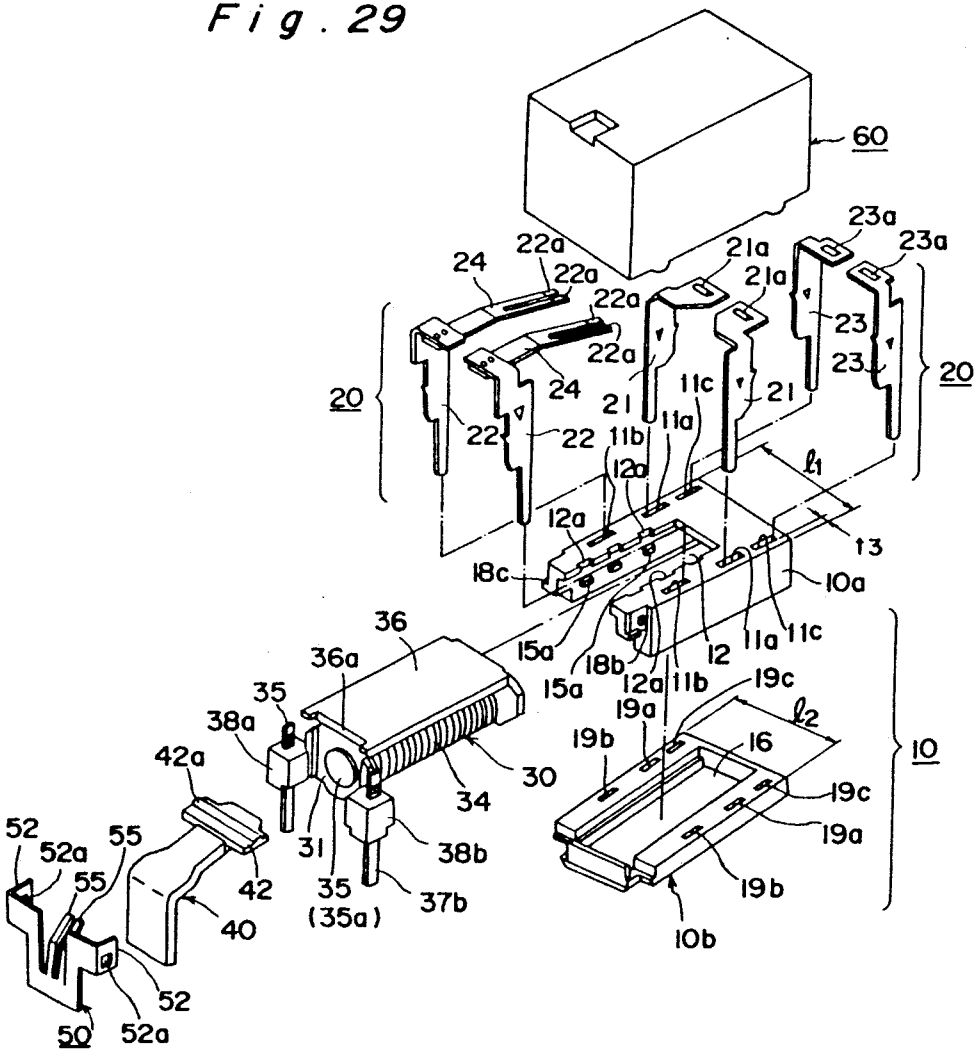
FIG. 29 and FIG. 30 show a fourth embodiment of an electromagnetic relay in accordance with the present invention.
Figure 30:
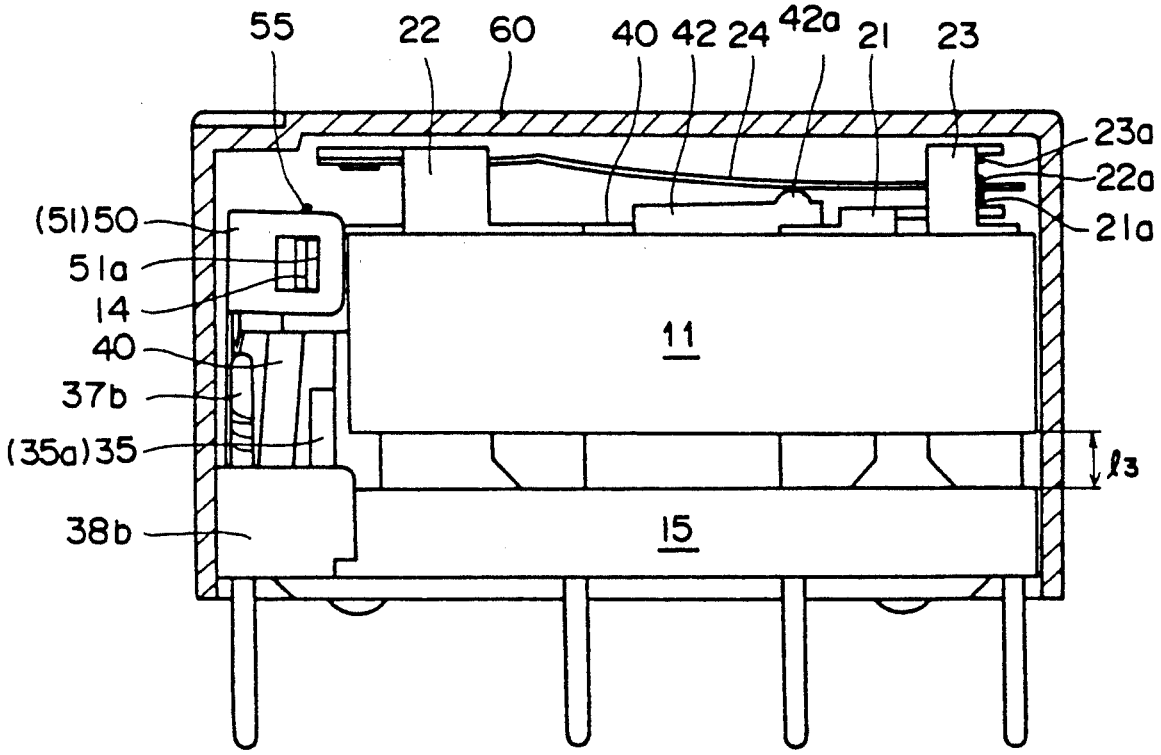
Figure 31:
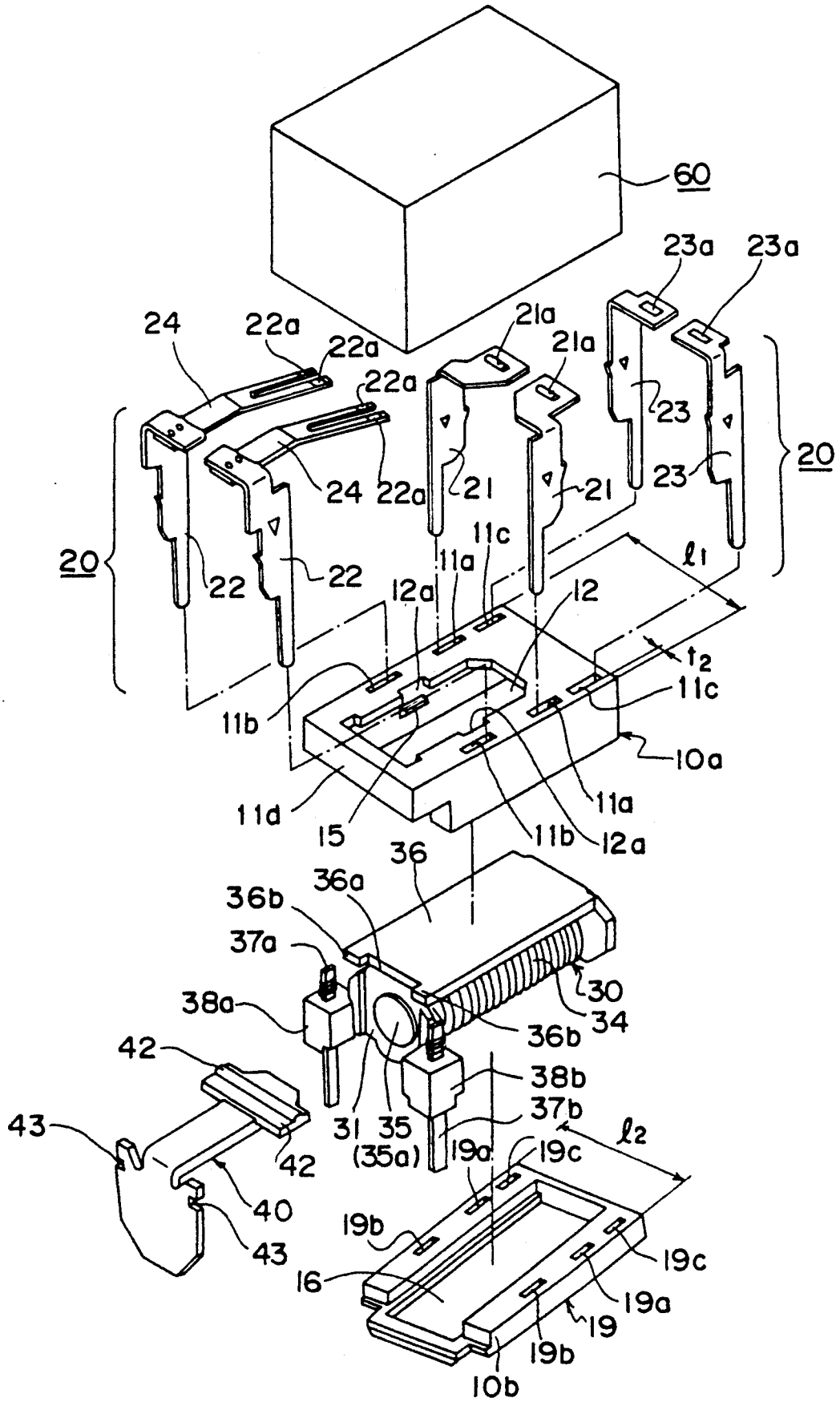
FIG. 31 through FIG. 35 show a fifth embodiment of an electromagnetic relay in accordance with the present invention.
Figure 32:
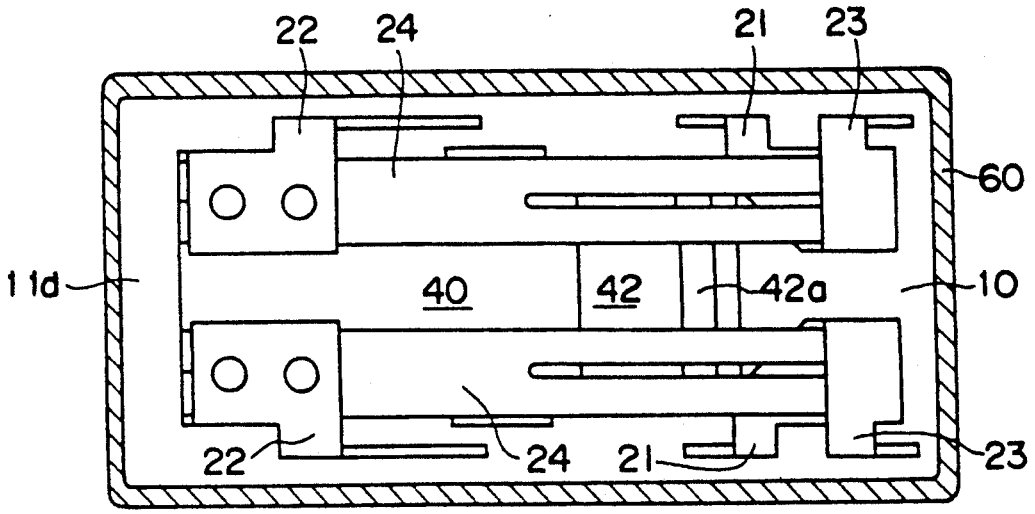

A fourth embodiment of the electromagnetic relay in accordance with the present invention will be described hereinafter with reference to accompanying drawings from FIG. 29 and FIG. 30.

The parts which are the same as in the first embodiment will be provided with the same numerals to omit the description thereof.

The electromagnetic relay in accordance with the present embodiment is roughly composed of a base 10, contact mechanism portions 20, 20, an electromagnet portion 30, a movable iron piece 40, a hinge spring 50 and a case 60.

The base 10 is composed of an upper base portion 10*a* and a lower base portion 10*b*, the upper base portion 10*a* is approximately ]-shaped in plan face, has terminal pressure-insertion holes 11*a*, 11*b*, 11*c* passing vertically through in the opposing side walls, has a notch portion 12*a* in both the side portions forming the upper opening portion 12, and also, a guide projection 15*a* for pressure insertion use (the guide projection portion on this side is not shown) is provided on the same linear line from the opposite inner side face to be positioned immediately under the notch portion 12*a*. Further, the width size l1 of the upper base portion 10*a* is equivalent to the width size l2 of the lower base portion 10*b* to be described later or is smaller by a drawn taper of the inner side face of the case 60 to be described later. Since the drawn taper of the case 60 is extremely smaller than the stage difference t1 in the above-described conventional embodiment, the thickness t3 of the portions near the terminal pressure-insertion holes 11*a*, 11*b*, 11*c* is larger than the thickness t2 in accordance with the conventional embodiment. Thus, the possibility of damaging is reduced at the terminal pressure-insertion, with an advantage that the support strength of the terminal is improved.

The lower base portion 106 has an approximately plan face which is almost the same in shape as the above-described upper base portion 11, the opposing both the side edge portions are provided respectively with terminal pressure-insertion holes 19*a*, 19*b*, 19*c* corresponding to the terminal pressure holes 11*a*, 11*b*, 11*c* of the upper base portion 10*a*, and also, the upper face central portion is provided with a concave 16 for fixedly placing the electromagnet portion 30 to be described later.

The contact mechanism portions 20, 20 are respectively provided in parallel on the upper face both the side edge portions of the upper base portion 11 through the respective inserting operations of the normally-closed fixed contact terminal 21, the movable contact terminal 22 and the normally-open fixed contact terminal 23 into the terminal pressure-insertion holes 11*a*, 11*b*, 11*c* of the upper base portion 10*a*.

The electromagnet portion 30 is provided with the coil 34 wound around the spool 31 having the flange portions at both the end portions thereof, and also, the iron core 35 of an approximately T-shape in section is press-fitted into the central hole of the spool 31 to turn the projecting one end portion into the magnetic pole portion 35*a*, while the projecting other end portion is fixedly crimped to the vertical portion of the yoke 36 bent into an approximately L-shape in section. The spool 31 is provided, on either side edge portion of one flange portion, with pedestal portions 38*b*, 38*b* with the coil terminals 37*b*, 37*b* being insert-molded.

Therefore, both the side edge portions of the yoke 36 of the electromagnet portion 30 are press-inserted along the guide projection 15*a* in the axial direction of the iron core 35 into an upper base portion 10*a* provided with contact mechanisms 20, 20 so as to integrate the upper base portion 10*a* with the electromagnet portion 30.

Then, the normally-closed fixed contact terminal 21, the movable contact terminal 22 and the normally-opened fixed contact terminal 23 press-fitted into the upper base portion 10*a* are respectively press-fitted into the terminal pressure-insertion holes 19*a*, 19*b*, 19*c* of the lower base portion 10*b*, and are projected so as to grasp the electromagnet portion 30 with the upper base portion 10*a* and the lower base portion 10*b* for the integration purpose. But a gap of l3 in size is formed between the upper base portion 10*a* and the lower base portion 10*b* as shown in FIG. 30.

According to the present embodiment, since the lower base portion 10*b* is engaged after the electromagnet portion 30 has been engaged with the upper base portion 10*a*, the electromagnet portion is not engaged with the box-shaped base at one time as shown in the conventional embodiment. Thus, the coil 34 is not caught with the upper base portion 10*a*, the lower base portion 10*b*, with an advantage that the wire becomes hard to disconnect.

As the movable iron piece 40 is a punched-out metallic plate which is bent into an approximately L-shape in section, the card 42 is provided at the horizontal tip end portion thereof, the top face of the card 42 is provided with a projection portion 42*a* which comes into contact against the movable contact pieces 24, 24.

Thus, the card 42 of the movable iron piece 40 is placed between the movable contact pieces 24, 24 and the top face of the upper base portion 10*a* so as to position the inner side face angle portion thereof into the positional concave portion 36*a* provided at the horizontal tip end portion of the yoke 36 so as to support the movable iron piece 40 in a manner of hinge, and also, to move the vertical portion thereof toward and away from the magnetic pole portion 35*a* of the iron core 35.

The engagement holes 52*a*, 52*a* provided in the elastic arms portions 52, 52 of the hinge spring 50 are respectively engaged with the projection 18*b* (the projection on the inner side is not shown) provided from the upper base portion 10*a*, so that the elastic pawl portions 55, 55 depresses the outer side face angle portion of the movable iron piece 40 in the plate thickness direction to pivotally support the movable iron piece 40 in a manner of hinge, and is prevented from being pulled out.

Embodiment 5

A fifth embodiment of an electronic relay in accordance with the present invention will be described with reference of FIG. 31 through FIG. 35 in accordance with the present invention.

The parts which are the same as in the first embodiment will be provided with the same numerals to omit the description thereof.

The electromagnetic relay in accordance with the fifth embodiment is roughly composed of a base 10, contact mechanism portions 20, 20, an electromagnet portion 30, a movable iron piece 40 and a case.

The base 10 is composed of an upper base portion 10*a* and a lower base portion 10*b*, the upper base portion 10*a* is approximately □-shaped in plan face, has terminal pressure-insertion holes 11*a*, 11*b*, 11*c* passing vertically through in the opposite side walls, has a notch portion 12*a* in both the side edge portions forming the upper opening portion 12, and also, a projection portion 15 is projected from the opposite inner side face to be positioned immediately under the notch portion 12*a*. Further, the width size l1 of the upper base portion 10*a* is equivalent to the width size l2 of the lower base portion 10*b* or is smaller by a drawn taper of the inner side face of the case 50 to be described later. Since the drawn taper of the case 50 is extremely small, the thickness t2 of the portions near the terminal pressure-insertion holes 11*a*, 11*b*, 11*c* is larger. Thus, the possibility of damaging is reduced at the terminal pressure-insertion, with an advantage that the support strength of the terminal is improved.

The lower base portion 106 has an approximate plan face which is almost the same in shape as the above-described upper base portion 10*a*, the opposing both the side edge portions are provided respectively with terminal pressure-insertion holes 19*a*, 19*b*, 19*c* corresponding to the terminal pressure holes 11*a*, 11*b*, 11*c* of the upper base portion 10*a*, and also, the upper face central portion is provided with a concave 16 for fixedly the placing electromagnet portion 30 to be described later.

The electromagnet portion 30 is provided with the coil 34 wound around the spool 31 having the flange portions at both the end portions thereof, and also, the iron core 35 of an approximately T-shape in section is press-fitted into the central hole of the spool 31 to turn the projecting one end portion into the magnetic pole portion 35*a*, while the projecting other end portion is fixedly crimped to the vertical portion of the yoke 36 bent into an approximately L-shape in section. The spool 31 is provided, on either side edge portion of one flange portion, with pedestal portions 38*b*, 38*b* with the coil terminals 37*b*, 37*b* being insert-molded. Further, the yoke 36 is provided with a concave portion 36*a* for positioning use in the horizontal tip end portion, and also, with a projection portions 36*b*, 36*b* for positioning use in both the side portions thereof. The concave portion 36*a* for positioning use is somewhat deeper than the thickness of the movable iron piece 40 to be described later.

Since the movable iron piece 40 is a punched-out metallic plate which is bent into an approximately L-shape, it has a card 41 at the horizontal tip end portion thereof, with the top face of the card 42 being provided with a projection portion 42*a* which comes into contact against the movable contact pieces 24, 24. Further, the movable iron piece 40 is provided, at both the side portions of the vertical portion, with notched portions 43, 43 which may be engaged with the projections 38, 38 for positioning use of the yoke 34.

Figure 35:
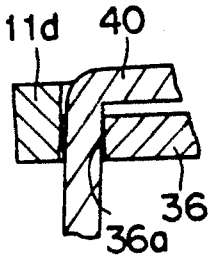

Thus, after the notch portions 43, 43 of the movable iron piece 40 are respectively engaged with the projection portions 38, 38 of the yoke 34, and the inner side face angle portion of the movable iron piece 40 is positioned in the concave portion 37 of the yoke 34 to pivotally support, the electromagnetic portion 30 is pressure-inserted from the lower side into the upper base portion 10*a* provided with the contact mechanism 20, 20 to engage both the side edge portions of the yoke 34 into the projection portion 15 provided on the upper base portion 10*a* (snap fit), so that the projection portions 38, 38 of the yoke 34 come into contact against one side portion 11*d* of the upper base portion 10*a* so as to integrate the upper base portion 10*a* with the electromagnet portion 30. Therefore, the movable iron piece 40 is prevented from being pulled out by the one side portion 11*d* of the upper base portion 10*a* and the concave portion 37 of the yoke 34, and also is pivotally supported (FIG. 35).

Further, in order to facilitate the engaging operation, a notch portion may be provided in one side portion 11*d* of the upper base 10*a*.

Figure 33:
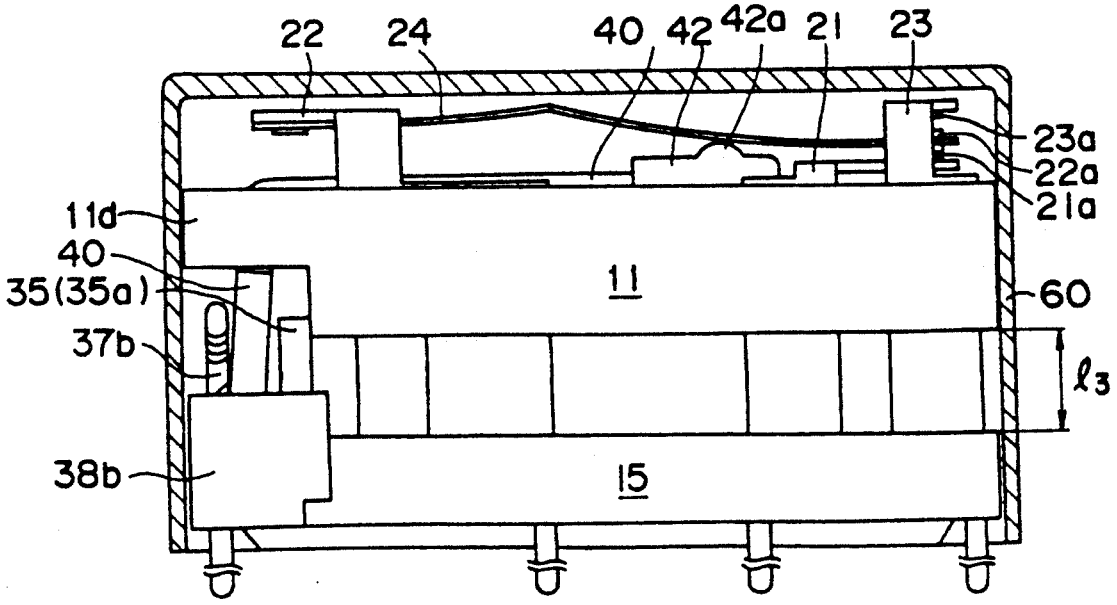
Figure 34:
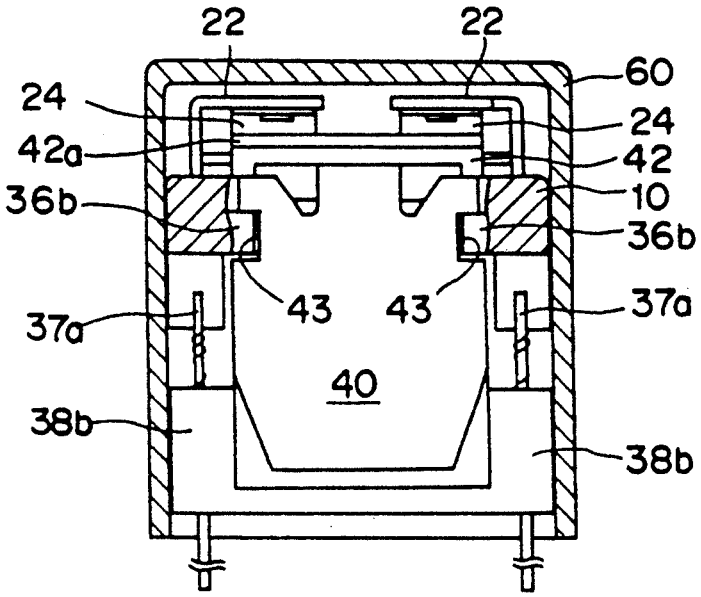

Then, the normally-closed fixed contact terminal 21 engaged with the upper base portion 10*a*, the movable contact terminal 22 and the normally-open fixed contact terminal 23 are respectively pressure-inserted and are projected from the terminal pressure-insertion holes 19*a*, 19*b* of the lower base portion 10*b* to grasp the electromagnet portion 30 with the upper base portion 10*a* and the lower base portion 10*b* for the integrating operation. However, the gap of the size l3 is formed as shown in FIG. 33 between the upper base portion 10*a* and the lower base portion 10*b*. According the fifth embodiment, since the lower base portion 10*b* is engaged with after the electromagnet portion 30 has been engaged with the upper base portion 10*a*, the electromagnet portion is not engaged with the box-shaped base at one one as in the conventional embodiment. Accordingly, a chance of catching the coil 32 in the upper base 10*a*, the lower base portion 10*b* is reduced to make it difficult to disconnect the wire.

Further, the movable iron piece 40 is prevented from being pulled out by one side portion 11*d* of the upper base portion 10*a* and the concave portion 37 of the yoke 34 simply by the engagement of the electromagnet portion 30 with the upper base portion 10*a*, and also, is pivotally supported, with an advantage of eliminating the necessity of the hinge spring.

According to the fifth embodiment, since there is a gap of l3 in width between the upper base portion 10*a* and the lower base portion 10*b*, the possibility of deeply penetrating the injected sealing agent into the interior thereof by the capillary action to stick it on the contact mechanism portion 20 and so on is prevented as an additional advantage.

The modified embodiment of the electromagnet apparatus in accordance with the present invention will be described hereinafter with reference to the accompanying drawings of FIG. 36 through FIG. 38.

Figure 36:
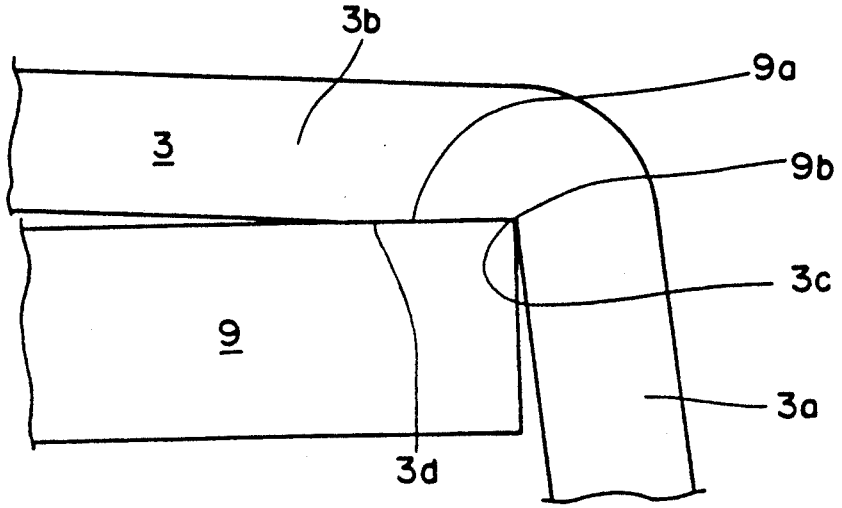
FIG. 36, FIG. 37, FIG. 38 are side views of essential-portions showing the first, second, third modified embodiments of the electromagnet apparatus in accordance with the present invention.

In the first embodiment in accordance with the present invention, as shown in FIG. 36, the thickness is made uneven through the press operation on the lower face operation 3*d* for forming the inner side face angle portion 3*c* of the movable iron piece 3 so that the lower face portion 3*d* and the upper face portion to be located near the tip end upper angle portion 7*b* of the yoke 9 are adapted to come into face contact against each other at the returning operation.

Figure 37:
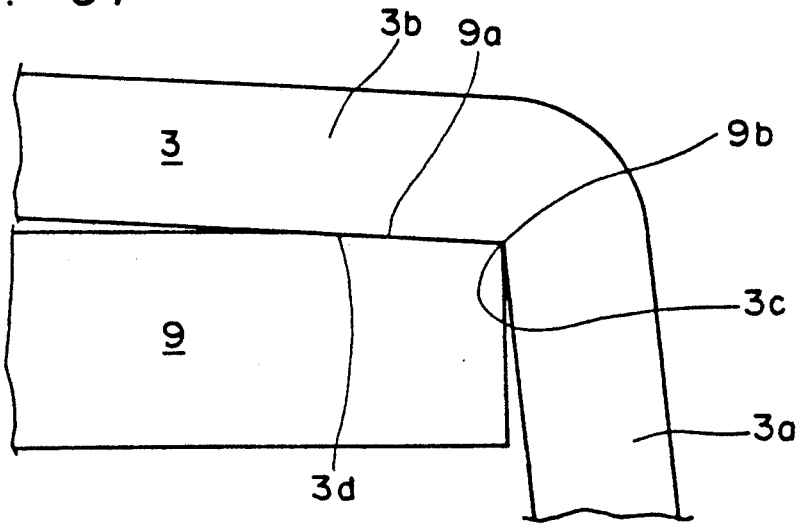
Figure 38:
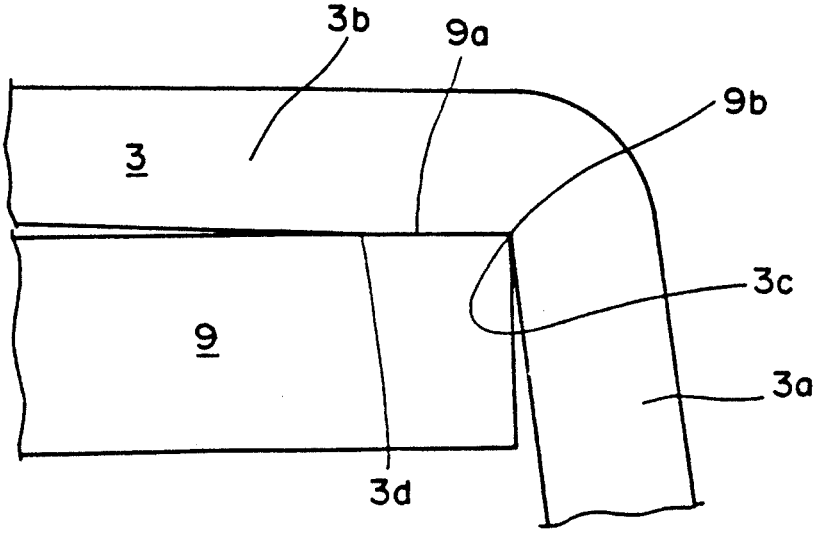
Figure 39:
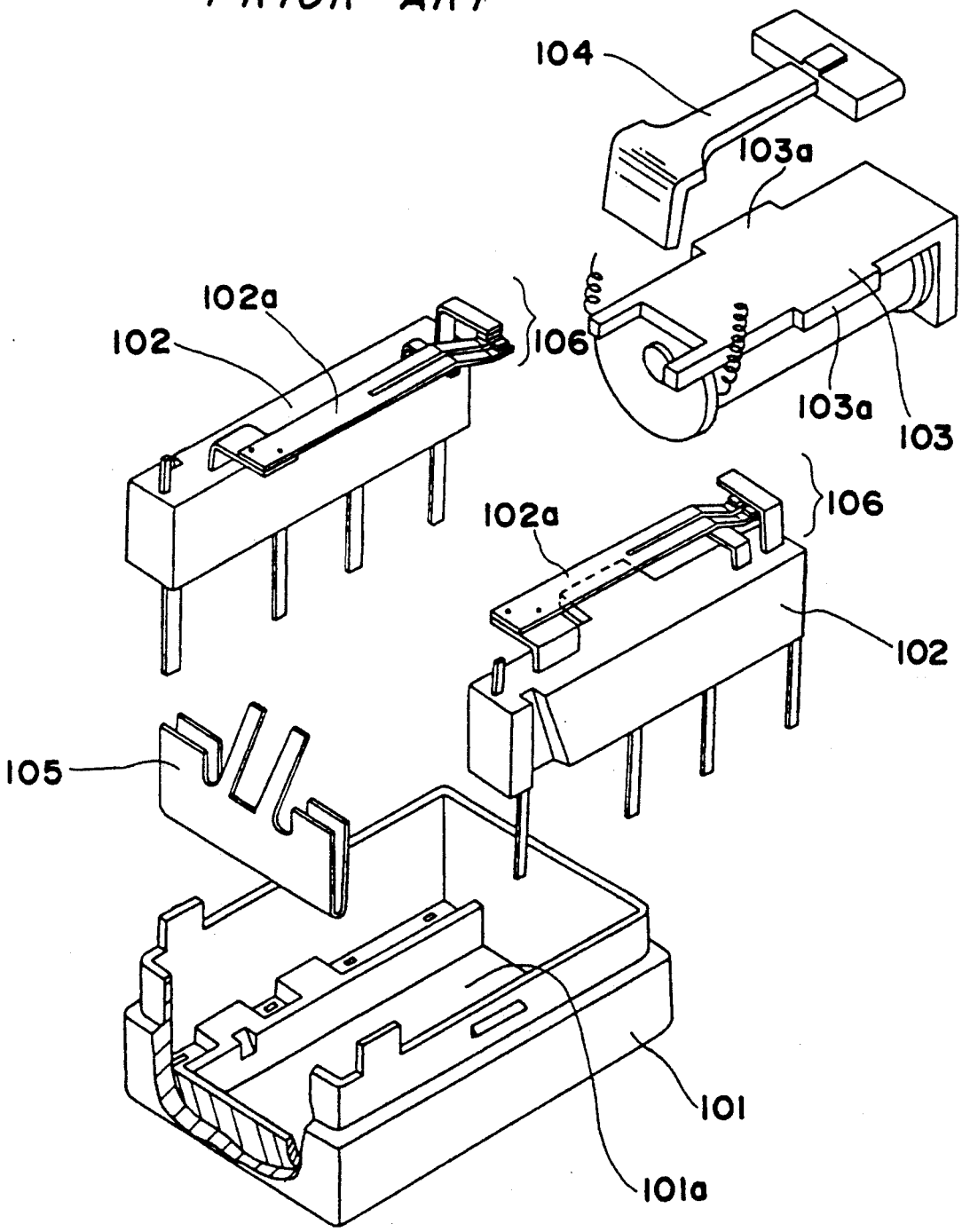
Fig. 39 PRIOR ART
FIG. 39 and FIG. 40 are an exploded perspective view and an perspective view of an electromagnetic relay in conventional as already referred above.
Figure 40:
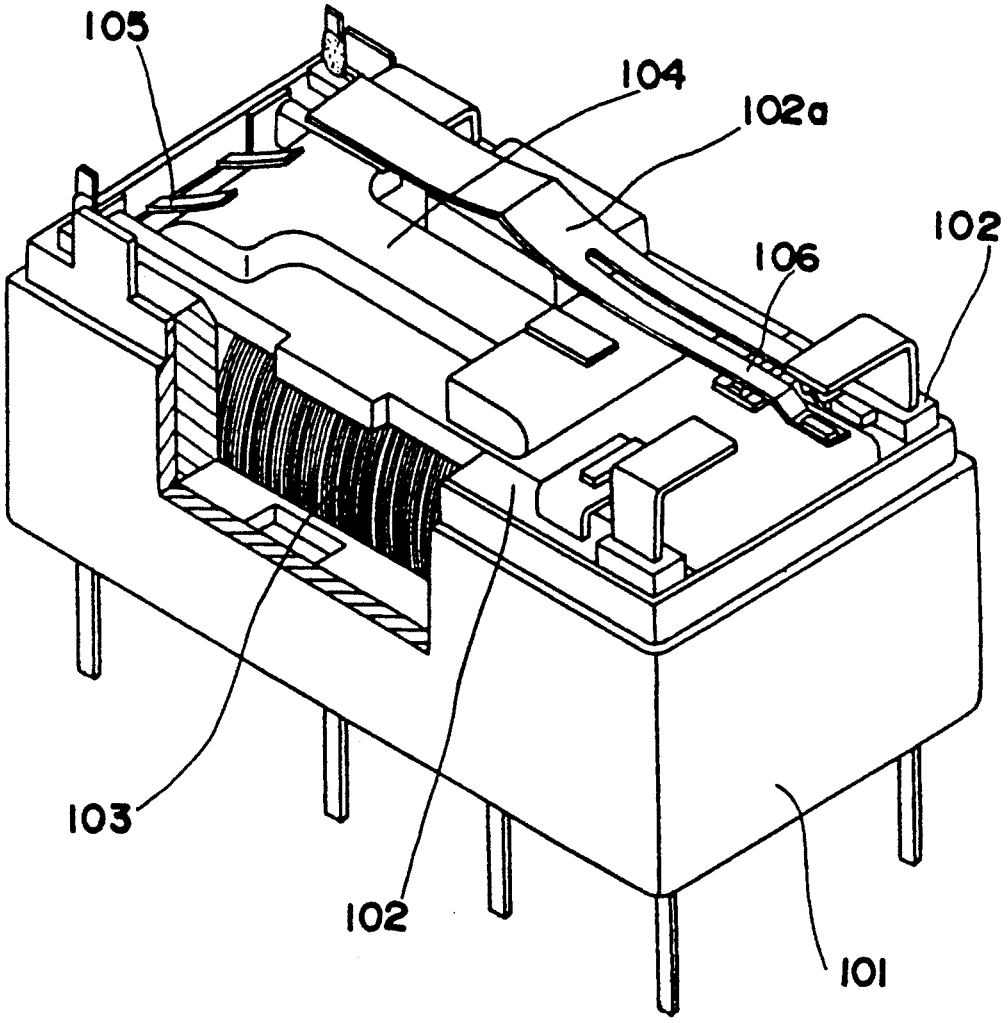
Fig. 40 PRIOR ART

In the second modified embodiment, as shown in FIG. 37, the upper face portion 9*a* to be located near the tip end upper angle portion 9*b* of the yoke 9 is turned into a taper face, so that the upper face portion 9*b* and the lower face portion 3*d* to be located near the inner side face angle portion 3*c* of the movable iron piece 3 are adapted to come into face contact against each other at the returning operation.

In the third modified embodiment, the horizontal portion 3*b* is bent, raised upward from near the inner side face angle portion 3*d* of the movable iron piece 3*c* so as to bring the top face portion 9*a* of the yoke 9 and the lower face portion 3*d* of the movable iron piece 3 into face contact against each other at the returning operation.

According to the above-described embodiment, since the upper face portion 9*a* to be located near the tip end upper angle portion 9*b* of the yoke 9 and the lower face portion to be located near the inner side face angle portion 3*c* of the movable iron piece 3 are in the face contact condition at the initial driving time of pivoting the movable iron piece 3 through the energization of the coil, the magnetic resistance becomes smaller than in the conventional embodiment. Therefore, if the same electric voltage is applied, the magnetomotive force larger than in the conventional embodiment is obtained so as to provide the card with the larger pressure applying force as an additional advantage.

What is claimed is:

1. An electromagnetic relay comprising a contact mechanism portion disposed above an electromagnet portion, the contact mechanism portion having terminals including contact portions, the electromagnet portion being fixedly pressing engaged into a base, and each terminal of the contact mechanism portion being fixedly pressure-inserted into the base from above, wherein the contact portions of the terminals are inserted pressingly in a vertical direction at the side close to the elevational side plane of the electromagnet and are positioned on the side plane of the electromagnet, and wherein the terminals as a whole are formed to cover over the electromagnet from the side of the side plane of the electromagnet to the upper plane.

2. The electromagnet relay of claim 1, further comprising a spool with a through hole in a barrel portion, a coil wound around the barrel portion of the spool, and an iron core which is prevented from being pulled out through pressure contact against an outer peripheral face thereof, the spool being made of profile memory synthetic resin, the iron core being inserted into the through hole and being pushed wider through the deformation of an inner peripheral face thereof and heated so that the inner peripheral face is restored into its original shape and is brought into pressure contact against the outer peripheral face of the iron core to prevent the pulling out operation.

3. The electromagnet relay of claim 1, wherein a coil is wound around an iron core with a stage portion formed at one end thereof, and an approximately L-shaped yoke is crimped, mounted so that the magnetic pole face of the iron core becomes flush with a tip end face of the yoke, wherein the length from the stage portion of the iron core to the magnetic pole face is longer than the length from the iron core fixed portion inner face of the yoke to the tip end face, and the yoke is lower in hardness than the iron core.

4. An electromagnetic relay comprising a box-shaped base with an opening portion provided therein sideways, an electromagnet portion for exposing the tip end portion of the yoke from the opening portion, a movable iron piece having an approximate L-shape in section with an inner side face angle portion being positioned in the tip end portion of the yoke, a hinge spring which has a pair of elastic arm portions cut, raised so as to oppose both the side portions, and also, has an elastic pawl portion cut, raised between the one pair of elastic arm portions, the engagement hole provided in the elastic arm portion being respectively engaged with the engagement projection provided on the outer side face of the opposing side wall of the base, the outer side face angle portion of the movable iron piece is depressed in the plate thickness direction by the elastic pawl portion to pivotally support the movable iron piece in a manner of hinge, characterized in that the relay of the present invention, a guide projection for guiding an elastic arm portion of the hinge spring is projected from the portion to be located near the opening portion among the outer side faces of the opposing side walls of the box-shaped base, and also, an inclination face is provided in at least either contact portion from between the elastic arm portion of the hinge spring and the engagement projection to come into contact when the hinge spring has been depressed along the guide projection.

5. An electromagnetic relay comprising a box-shaped base, wherein an opening portion is provided sideways, a pair of arm portions are provided with a drop groove are projected sideways from the upper portion of the edge portion end face for forming the opening portion, an electromagnet portion, wherein a coil is wound around a spool having a flange portion on both the end portions, an iron core is inserted into the central hole of the spool, a projecting one end portion is provided as a magnetic pole portion, while the projecting other end portion is secured to the vertical portion of a yoke having an approximate L-shape in section, and also, a pair of engagement pawl portions are projected from the lower portion on the outer side face of one flange portion, the one pair of engagement pawl portions are exposed sideways through the pressure insertion, the fixing in the axial direction of the iron core from the opening of the box-shaped base, a movable iron piece, wherein the shape is approximately L in section, the inner side face angle portion is pivotally positioned in the horizontal tip end portion of the yoke to be exposed from the opening portion of the box-shaped base, a hinge spring, wherein it is made of a leaf spring, the engagement arm portion projected sideways from the upper portion on both the sides is dropped from above into the drop groove of the box-shaped base to effect the engagement, and also, the engagement leg portion projected sideways from the lower portion on both the sides are engaged with the engagement pawl portion of the spool to bring the elastic pawl portion cut, raised from the central portion into pressure contact against the outer side angle portion of the movable iron piece to pivotally support it.

6. The electromagnetic relay of claim 1, wherein an electromagnet portion is accommodated and secured within a box-shaped base having an upper opening portion to be opened at least upwardly, a terminal pressure insertion hole which vertically extends through is provided in the side wall of the box-shaped base, wherein a terminal is inserted under pressure into the terminal pressure-insertion hole to form a contact mechanism portion, the box-shaped case is covered on the box-shaped base, a sealing agent is injected, hardened into the engagement portion to effect the sealing operation, so that the box-shaped base is vertically divided into two portions, an upper base portion and a lower base portion, the electromagnet portion is grasped integrally by the upper base portion and the lower base portion, and a gap is provided between the upper base portion and the lower base portion.

7. The electromagnet relay of claim 1, wherein an electromagnet portion with one end portion of an iron core with a coil being wound around it being provided as a magnetic pole portion, and the other end portion of the electromagnet portion being secured to the vertical portion of the yoke bent into an approximate L-shape in section is accommodated and secured within a box-shaped base having an upper opening portion, the contact mechanism portion formed through the pressure insertion of the terminal in the vertical direction into the side wall of the box-shaped base with a movable iron piece approximately L-shaped in section being pivoted with a horizontal tip end portion of the yoke as a support point in accordance with energization and deenergization of the electromagnet portion, wherein both the side edge portions of the yoke of the electromagnet portion are respectively engaged with and secured onto, from the lower side, a projection portion provided on at least the opposing inner side face of the box-shaped base and the horizontal tip end portion of the yoke.

8. The electromagnet relay of claim 1, wherein a projecting end portion of an iron core with a coil wound around it is provided as a magnetic pole portion, while a vertical portion of a yoke bent into an approximately L-shape in section is secured onto another projecting end portion of the iron yoke, and an inner side face angle portion of a movable iron piece bent into approximately an L-shape in section is positioned and pivotally supported on an upper angle portion of a tip end of the horizontal portion for forming the yoke, wherein the upper face portion to be located near the tip end upper angle portion from the upper face of the horizontal portion for forming the yoke, and the lower face portion to be positioned near the inner side face angle portion from the inner side face of the movable iron piece are brought into face contact against each other during the deenergization of the coil.

9. The electromagnet relay of claim 1, wherein the contact portions of the terminals are formed in a plane of the direction along the electromagnet at the vertical positions of the terminals.

10. The electromagnet relay of claim 1, wherein the terminals comprise a fixed terminal inserted pressingly in series in the direction along the electromagnet at the vertical portion adjacent to the one end of the electromagnet to arrange in the upper and lower direction at the contact portion, and a movable terminal inserted pressingly at the vertical portion close to the other end of the electromagnet to extend in the direction of the one end so as to cover a movable element over the electromagnet and to provide at the end a contact among the contacts of the fixed terminal.

11. The electromagnet relay of claim 1, wherein the terminals comprise a pair of fixed terminal and movable terminal to be provided at the both sides of the electromagnet, the fixed terminal being inserted pressingly in series in the direction along the electromagnet at the vertical portion adjacent to the one end of the electromagnet to arrange in the upper and lower direction at the contact portion, and the movable terminal being inserted pressingly at the vertical portion close to the other end of the electromagnet to extend in the direction of the one end so as to cover a movable element over the electromagnet and to provide at the end a contact among the contacts of the fixed terminal.

* * * * *

UNITED STATES PATENT AND TRADEMARK OFFICE

CERTIFICATE OF CORRECTION

PATENT NO. : 5,041,870

DATED : August 20, 1991

INVENTOR(S) : Yoshikiyo Imai, Yoshiharu Kitagawa

It is certified that error appears in the above-identified patent and that said Letters Patent is hereby corrected as shown below:

On the title page: [ITEM] 75, change the third inventor's name from "Yuji Yoasuoka" to --Yuji Yasuoka --.

Signed and Sealed this

First Day of June, 1993

*Attest:*

Michael K. Kirk

MICHAEL K. KIRK

*Attesting Officer*

*Acting Commissioner of Patents and Trademarks*